US009328516B2

(12) United States Patent
Albert et al.

(10) Patent No.: US 9,328,516 B2
(45) Date of Patent: May 3, 2016

(54) TRELLIS WITH INTERNAL DRAINAGE SYSTEM

(71) Applicant: Division 8 Products, Inc., Fredric, WI (US)

(72) Inventors: Ned Albert, Burnsville, MN (US); Eric Goodman, Newport, MN (US); Timothy J. Michel, Lindstrom, MN (US)

(73) Assignee: Division 8 Products, Inc., Frederic, WI (US)

( * ) Notice: Subject to any disclaimer, the term of this patent is extended or adjusted under 35 U.S.C. 154(b) by 0 days.

(21) Appl. No.: 14/512,611

(22) Filed: Oct. 13, 2014

(65) Prior Publication Data

US 2015/0101260 A1 Apr. 16, 2015

Related U.S. Application Data

(60) Provisional application No. 61/890,660, filed on Oct. 14, 2013.

(51) Int. Cl.
*E04F 10/00* (2006.01)

(52) U.S. Cl.
CPC ..... *E04F 10/005* (2013.01)

(58) Field of Classification Search
CPC ..... E04B 7/14; E04C 2/08; E04C 2/384; E04D 13/0445; E04F 10/005
USPC ..... 52/15, 74–76, 273
See application file for complete search history.

(56) References Cited

U.S. PATENT DOCUMENTS 1,579,289 A 4/1926 Edwards
2,539,705 A 1/1951 Simonton
2,618,820 A 11/1952 Struben et al.
2,735,224 A 2/1956 Estey
2,848,764 A 8/1958 Turteltaub
3,107,401 A 10/1963 Heirich
3,113,434 A * 12/1963 Phillips ..... E04B 7/20 52/11
3,218,773 A 11/1965 Heirich
3,289,351 A 12/1966 Ford
3,300,941 A 1/1967 Heirich
3,388,510 A 6/1968 Smith et al.
3,396,496 A 8/1968 Roberts
3,402,516 A 9/1968 Kanarr
3,984,951 A 10/1976 Hindman
4,100,703 A 7/1978 Sickler
4,285,175 A 8/1981 Struben et al.
4,411,109 A 10/1983 Struben et al.
4,726,153 A 2/1988 Adler et al.
5,044,131 A 9/1991 Fisher
5,109,643 A * 5/1992 Speers ..... E04B 7/00 52/220.3
5,242,004 A 9/1993 Stilling
5,469,672 A 11/1995 Fisher
6,167,897 B1 * 1/2001 Resso ..... E04F 10/005 135/121
7,849,638 B2 * 12/2010 Braunstein ..... E04B 2/96 52/582.1
8,037,645 B2 * 10/2011 Michel ..... E04F 10/005 52/151
2009/0277113 A1 * 11/2009 Taraba ..... E04D 3/352 52/302.1
2011/0302871 A1 * 12/2011 Michel ..... E04F 10/005 52/653.2

* cited by examiner

*Primary Examiner* — Beth Stephan
(74) *Attorney, Agent, or Firm* — Patterson Thuente Pedersen, P.A.

(57) ABSTRACT

A trellis system including a front tube, a back tube, and two end tubes joined together, a plurality of roof panels, each panel having a perimeter, wherein the perimeter of the panel is coupled to at least a back tube surface and a front tube surface. An internal drainage system facilitates drainage of precipitation from the trellis. The internal drainage system further comprises an internal channel located within the tube member.

24 Claims, 34 Drawing Sheets

TRELLIS WITH INTERNAL DRAINAGE SYSTEM

RELATED APPLICATION

The present application claims the benefit of U.S. Provisional Application No. 61/890,660, entitled "Trellis with Internal Drainage System", filed Oct. 14, 2013, which is incorporated herein in its entirety by reference.

FIELD OF THE INVENTION

The invention is generally related to a building trellis or overhang, and installation of the trellis or overhang system on a building. More particularly, the invention is directed to a trellis or overhang structure that is attached to the side of a building thus achieving an aesthetically pleasing appearance as well as protection from the elements.

BACKGROUND OF THE INVENTION

The exterior of a building can be modified with an awning, trellis or overhang structure to provide the building with additional exterior coverage. The awning, trellis or overhang can provide additional shade to the building and to the area underneath the awning, trellis, canopy or overhang, as well as protection from the elements such as rain, snow, and ice. Canvas awnings that roll-up are popularly used for store fronts and restaurants, to provide shade, protection from the rain, and can be aesthetically appealing to consumers. Generally, a winding device is used to roll/fold these canvas awnings into place against the building front when the awning is no longer desired. These canvas awnings are not designed to withstand severe weather; heavy snow, rain or wind, and are more a decorative and shade-providing device. However, some awnings are made from metal, such as aluminum, and are generally sturdier than the canvas awnings, and can also be folded away when no longer desired. These types of awnings generally slope away from the building such that any rain, snow or ice slides off the edge of the awning where it may fall onto visitors to the building or onto pavement where, in freezing weather conditions, ice may form creating a safety hazard. Further, these awnings generally have many parts, are time-consuming to install, and have aesthetically unpleasing exposed fasteners.

Some buildings can have a trellis or overhang attached to the side of the building. Oftentimes the trellis or overhang is attached to the side of the building and the roof of the trellis/overhang is supported by columns or posts. Such an overhang structure attached to the side of a house often functions as a carport. Generally, the roof comprises a number of flat panels made of metal, plastic or wood. Also, a trellis/overhang constructed with posts supporting the roof of the trellis/overhang is subject to cars and people running into the posts. The posts may be especially prone to be damaged if the trellis/overhang is attached to a business, such as a bank with a drive-up window. Drivers of cars may misjudge distances and damage the posts supporting the roof.

There is still room for improvement in a trellises, awnings or overhangs to handle precipitation that may accumulate on the upper surfaces of such structures.

SUMMARY OF THE INVENTION

The present invention is directed to a trellis, canopy or overhang for mounting to the side of a building. The structure can be variously referred to as a trellis, an overhang, an awning, a canopy or a sunshade. Hereinafter, the term trellis will be used for the inventive structure. Generally, the trellis is made of metal, for example, aluminum; however other materials can be used in constructing the trellis.

In one aspect of the invention, the trellis includes in-fill panels that form the cover or roof structure of the trellis, the in-fill panels connected to one another by tubular cross-members or outriggers. In some prior art, the in-fill panels are angled such that rain and melting snow is urged off the panels and onto the ground, through drains positioned at the edges of the in-fill panels. According to one example embodiment of the invention, an internal drain channel receives and channels draining precipitation so that water that leaves the trellis exits at a desired location that does not affect visitors under the trellis and minimizes creation of a safety hazard. Further, the trellis is affixed to the side of the building by way of a series of turnbuckles or other structure, which are also utilized to level the trellis structure. The internal drainage system can also be utilized on canopies that have ground engaging supports, such as carports. The support structures allow for ease of arranging the trellis to the level arrangement desired and so that water is directed to the internal drain gutter.

In another aspect of the invention, the in-fill panels of the trellis are connected to one another by cross members. A cross member includes a hollow tube, for example with a quadrilateral cross-section, that also includes a threaded rod or other supporting member. Where used, the ends of the threaded rod are attached to the back tube of the trellis and the front tube (or fascia) of the trellis. The end of the threaded rod attached to the back tube includes a nut which can be tightened, thus securing and tightening the in-fill panels and front and back tubes in place.

In yet another aspect of the invention, the trellis can be largely pre-assembled at another location and brought to the installation site essentially ready to affix to the side of the building. The trellis is formed from in-fill panels, for example in 4 foot wide and 6 foot long sections. Often, the required length for the trellis is 24 feet; hence four such in-fill panels can be attached to one another and to the 24 foot front and back support tubes to form the required length. Further, because the trellis is modular, if a part of the trellis is damaged, for example, hit by a truck, then the in-fill panel can be removed and replaced. The trellis does not require posts or columns to support the roof; the turnbuckles and fasteners affixing the back tube to the building provide the necessary support.

In another aspect of the invention, the trellis system includes the trellis structure as well as accent banding that can be affixed to the building, to give the building an aesthetically pleasing appearance while also providing desired drainage control. The back surface of the accent band includes a plurality of square, rectangular or keyhole slots. The accent band can be affixed to the building using a plurality of carriage bolts or other mechanical anchors affixed to the building side that engage with a matching plurality of keyhole slots in the back surface of the accent band. The accent band that is proximate the trellis structure can be joined to the trellis, for example, to the trellis back tube, by way of a splice sleeve, thereby forming an unobtrusive hairline joint.

In another aspect of the invention, the in-fill panels are riveted to the cross members or cross-members, to hold the in-fill panels in place. The panels are designed such that the lower face of the panel is pleasing in appearance, as that is the surface that will be visible to the public. Further, the structure of the trellis does not require bolts, rivets, or other fasteners to be used in the front surface of the front tube or fascia, or in the front face of the exterior side tubes of the trellis. Hence, the trellis of the invention presents a visually appealing surface, with no or minimal fasteners showing.

In yet another aspect of the invention, the trellis includes in-fill panels that comprise stiffeners. In one aspect, the stiffeners take on the shape of a hat channel, that is, a channel shaped, in cross section like an upside-down top hat. However, other stiffener shapes are contemplated including rectangular or square members based on structural needs. The stiffeners are affixed, by fasteners or industrial adhesive, to the top surface of the in-fill panels, to provide for additional strength to the panels. The stiffeners provide additional strength against accumulated snow, in cold climates, and against updrafts in coastal regions or regions where high wind forces may exist.

According to another example embodiment of the invention, the trellis system includes an internal drain system that drains water from precipitation that would otherwise accumulate on the infill panels and drain off the edge of the trellis to an undesired location. The internal drain system is effective while not presenting any unsightly external drain structure. The internal drain system of an embodiment of the invention redirects water from precipitation to a location away from visitors to the building, automobiles that may pass under the trellis and into areas where it is less likely to create a slip and fall hazard in freezing temperatures when the precipitation may freeze.

According to an example embodiment of the invention, the infill panels are coupled to a tube member of the trellis. In different embodiments of the invention, the tube member to which the infill panels are coupled and toward which the infill panels drain is the front tube member, the back tube member or even a side tube member. The tube members may have a cross section that includes completely rectangular or square or round tubes or may be partial tubes having a generally C-shaped cross-section. The infill panels are coupled to the tube member via multiple drain slots or by a continuous drain slot by which precipitation drains from the lower edge of the infill member into an internal channel via a drip edge. The internal channel is then appropriately sloped to drain water from precipitation to a desired location where it drains from the tube member.

According to an example embodiment of the invention, the channel, when viewed in cross-section, includes a short side, a tall side and a bottom. The channel may be formed from any substantially rigid water resistant material such as metals or polymers. The channel is conveniently formed as an extrusion having a cross section as described above. Alternately, the drain channel can have a symmetrical cross section.

According to an example embodiment of the invention, the tall side of the channel is located at the outside aspect of the tube member while the short side of the channel is located at the inside aspect of the tube member adjacent the wall which abuts the infill panel. According to an example embodiment of the invention, the short side of the channel displays a short side flange while the long side of the channel presents a long side flange. The short side flange and long side flange are adapted to couple to the inside the tube member to allow the channel to be secured with an appropriate down slope to direct the drainage of water to a desired location via which it can then drain from the tube member. The short side of the channel is advantageous in that it permits the sloping of the channel to drain appropriately while not obstructing the drainage slots and permitting water to pass from the downward edge of the infill panel through the drain slots into the channel so that it can drain away.

According to different embodiments of the invention, the drain locations may be conveniently at outer corners of the trellis and outer ends of the front tube member so that water is directed away from for example a doorway entry. According to another embodiment of the invention, the drain locations may be made at wall side corners of the trellis system so that water that drains can be directed to a downspout. According to one example embodiment of the invention, the downspout is located internal to the building and joins the building drains from a flat roof that also drains internal to the building. According to another embodiment of the invention, the internal channel is coupled to the interior of the tube member by the application of an adhesive sealant.

Accordingly, water from precipitation that comes to rest on top of the infill panels drains down the slope of the infill panel toward one or more drain openings which then allow passage to the interior of the tube member, water then flows into the drain slots into the channel to its lower end to a drain hole either at one end of the tube member or to a downspout or other passage to which the water drain can be directed with other precipitation to a desired draining location. Water can also be directed around a corner to an adjacent member having a drain outlet.

The above summary of the various representative embodiments of the invention is not intended to describe each illustrated embodiment or every implementation of the invention. Rather, the embodiments are chosen and described so that others skilled in the art may appreciate and understand the principles and practices of the invention. The figures in the detailed description that follows more particularly exemplify these embodiments.

BRIEF DESCRIPTION OF THE DRAWINGS

These as well as other objects and advantages of this invention will be more completely understood and appreciated by referring to the following more detailed description of the exemplary embodiments of the invention in conjunction with the accompanying drawings. The invention will be explained in more detail below, by way of example and with reference to the enclosed drawings, which also disclose features essential to the invention and wherein.

Figure 1:
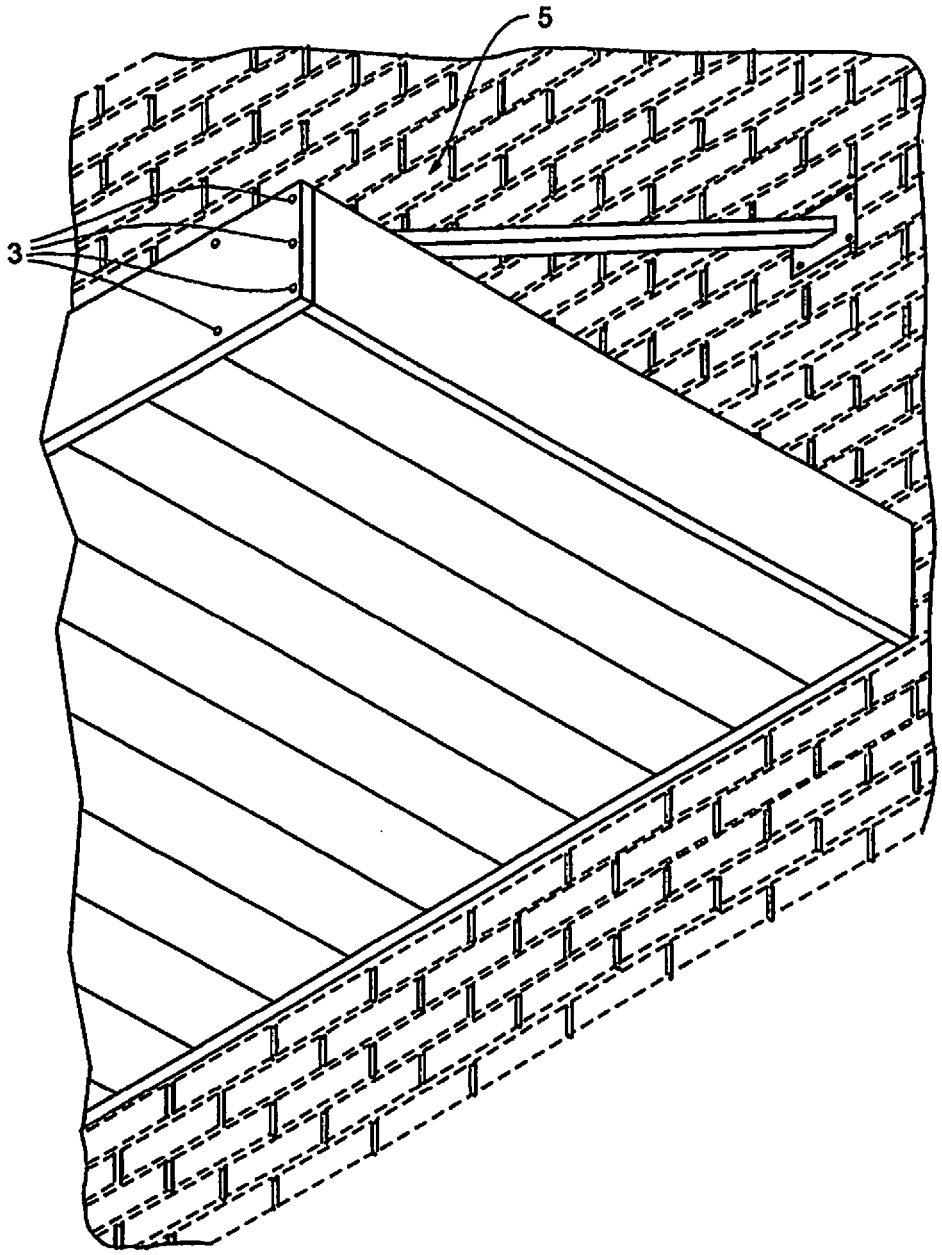
Fig. 1 Prior Art
FIG. 1 is a bottom perspective view of a prior art trellis, showing the attachment to a building.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives.

DETAILED DESCRIPTION OF THE DRAWINGS

Figure 2:
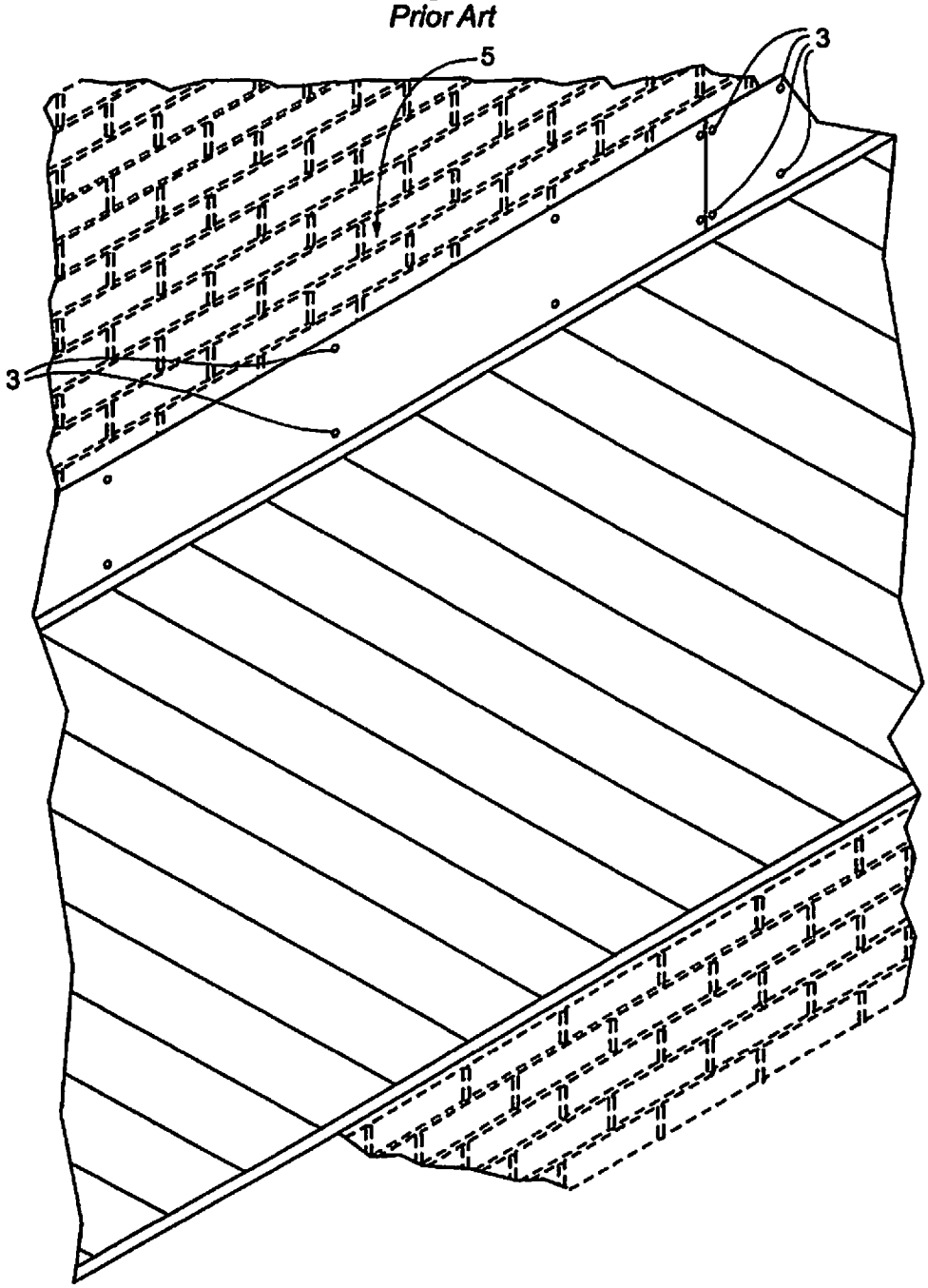
Fig. 2 Prior Art
FIG. 2 is a bottom perspective view of a prior art trellis.

FIGS. 1 and 2 show examples of a prior art trellis structure 5. The trellis 5 in each figure, noticeably, has fasteners 3 showing on the exterior of the trellis 5. In particular, the fastener heads 3 can be seen on the front fascia or facing of the trellis 5. The positioning of the fasteners 3 on the front fascia allows for the fasteners 3 to be generally seen by the public, resulting in a less than aesthetically pleasing frontage. Because the types of trellises 5 shown in FIGS. 1 and 2 are often used in consumer related businesses, for example, bank drive-up windows, fast food drive-up windows, and coffee purveyor drive-up windows, the businesses generally desire to have an aesthetically pleasing frontage that is also efficiently and economically constructed and installed.

Figure 3A:
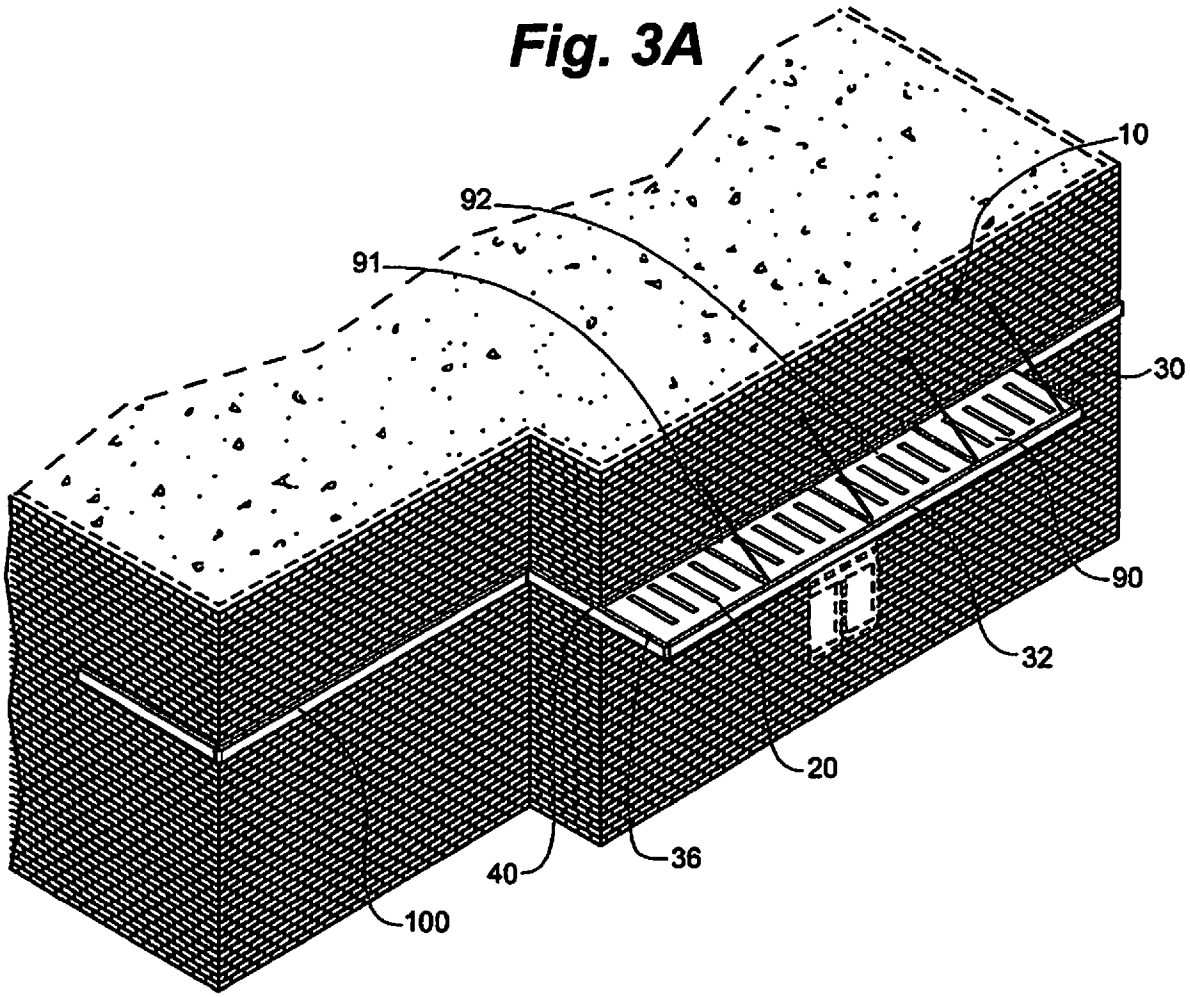
FIG. 3A shows a top perspective view of an embodiment of a trellis of the invention.
Figure 3B:
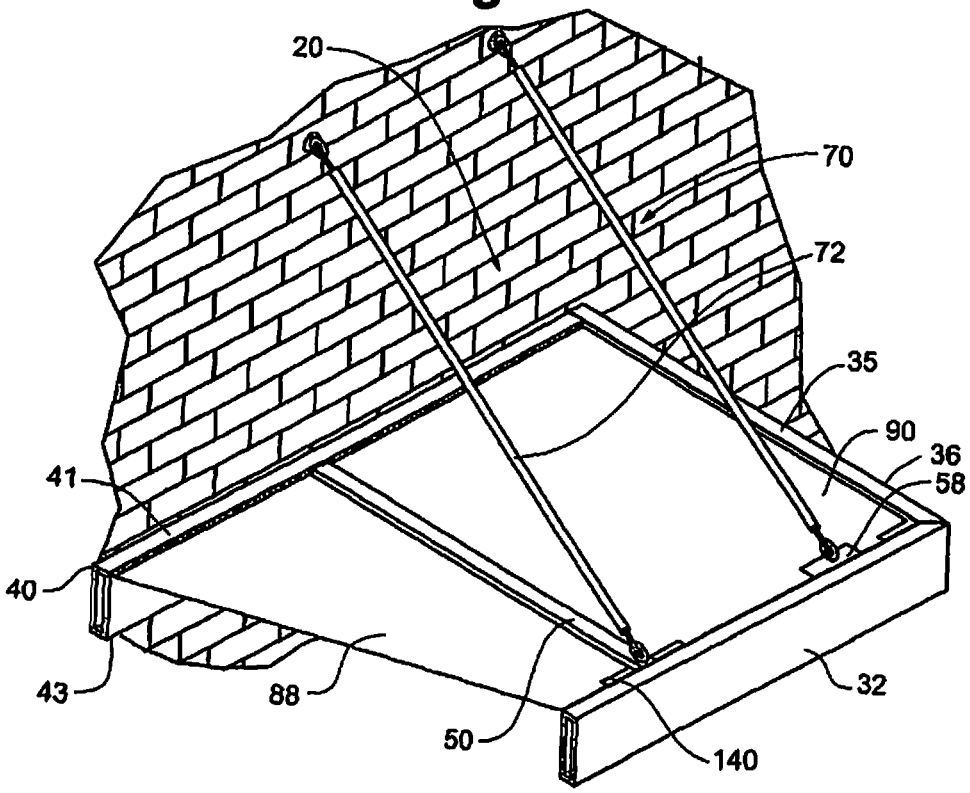
FIG. 3B shows a closer top perspective view of a trellis.
Figure 4:
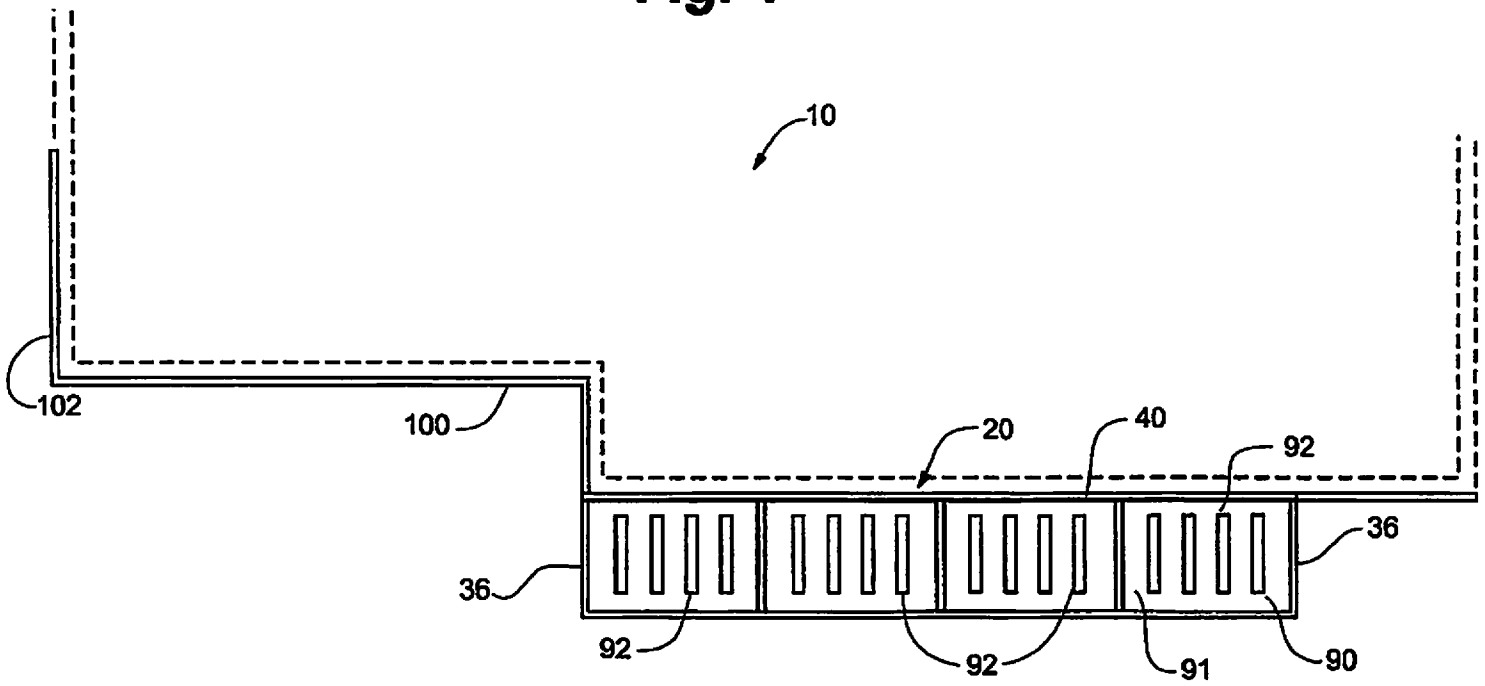
FIG. 4 shows a top planar view of a trellis.
Figure 18:
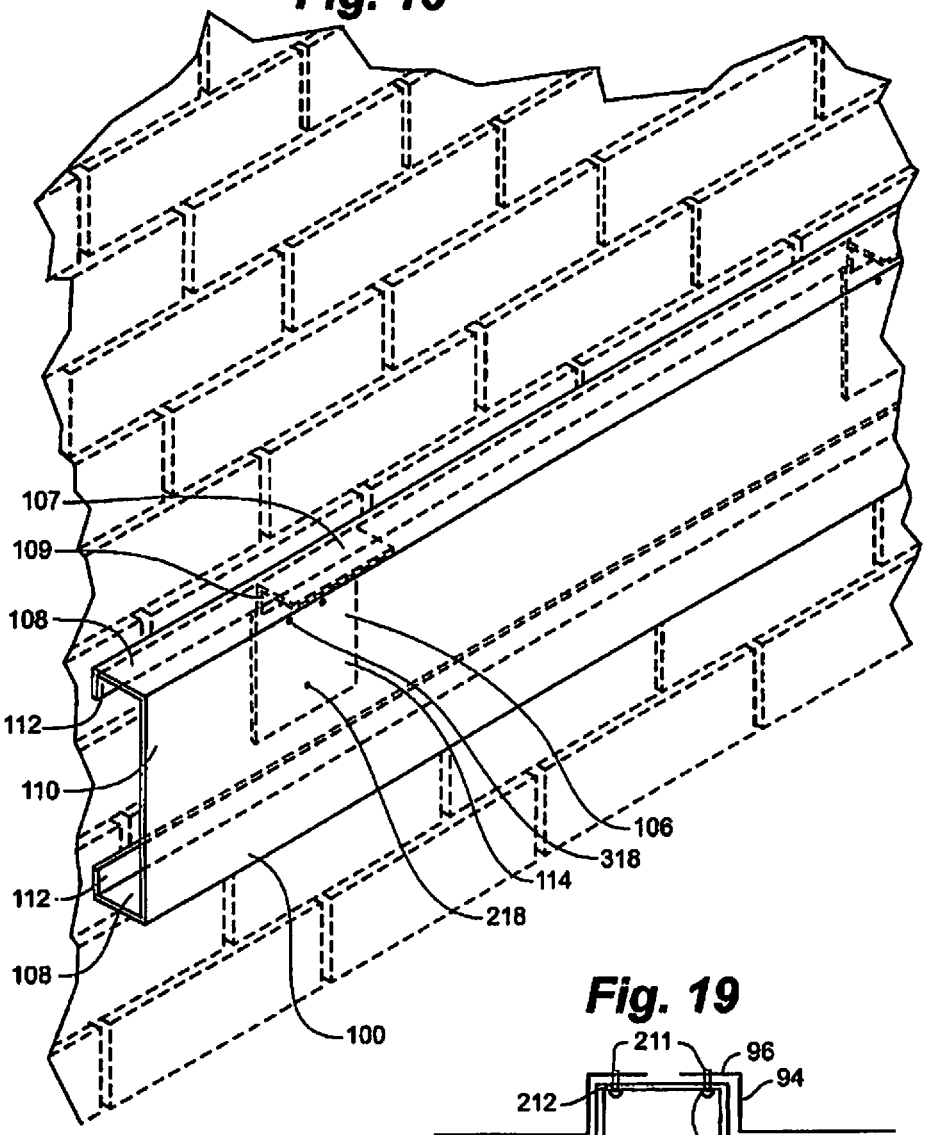
FIG. 18 shows perspective view of a C-shaped accent band attached to a wall.

Referring to FIGS. 3A, 3B, and 4, a trellis system 10 is depicted, wherein the trellis system 10 includes a trellis 20 and accent bands 100. The trellis 20 includes a frame structure 30, in-fill panels 90, cross member assemblies 50, and attachment assemblies 70. The frame structure 30 comprises a fascia or front tube 32, a back tube 40 and end tubes 36. Generally, the front tube 32, back tube 40 and end tubes 36 comprise elongated tubes with a quadrilateral cross-section, and preferably a rectangular cross-section. The accent bands 100 comprise elongated tubes that can be affixed to the side of the building, wherein the accent bands 100, in one embodiment, harmoniously blend with the structure of the trellis. In another embodiment, the accent bands 100 can provide a counterpoint with the trellis, if that is the desired aesthetic appearance. The accent bands 100 also are elongated tubes with a quadrilateral cross-section, and preferably a rectangular cross-section. Alternatively, the accent bands 100 can be C-shaped, as shown in FIG. 18 or have a C-shaped cutout, with a flange 112 extending from each horizontally planar surface 108 edge of the C-shape, the flange substantially orthogonal to the planar surface 108 of the C-shape. In a preferred embodiment, the accent bands 100 are 8 feet long and 2 feet wide.

The components of the trellis 20 are generally made of metal, for example, aluminum or a ferrous alloy. Other materials, for example, plastic, can also be used. Preferably, the trellis 20 is made of aluminum. For example, the front tube 32, back tube 40, end tube 36 and cross member tube 52 are preferably made of extruded aluminum. Using aluminum for other components allows the various components of the trellis 20 to expand and contract together, because of similar/the same coefficient of expansion. However, some of the support components of the trellis 20 can be made of steel for added strength.

Figure 5A:
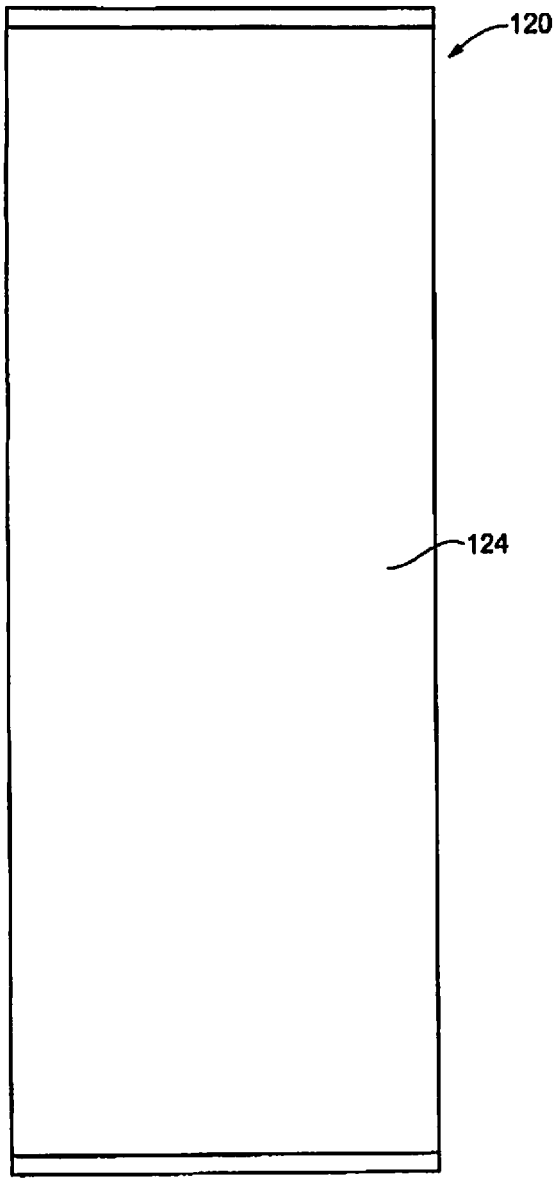
FIGS. 5A and 5B show a back view of a splice sleeve and side view of a splice sleeve.
Figure 5B:
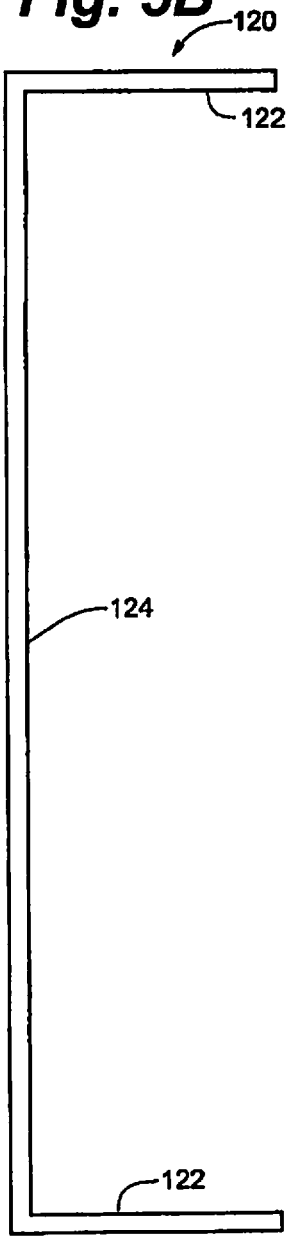
Figure 6:
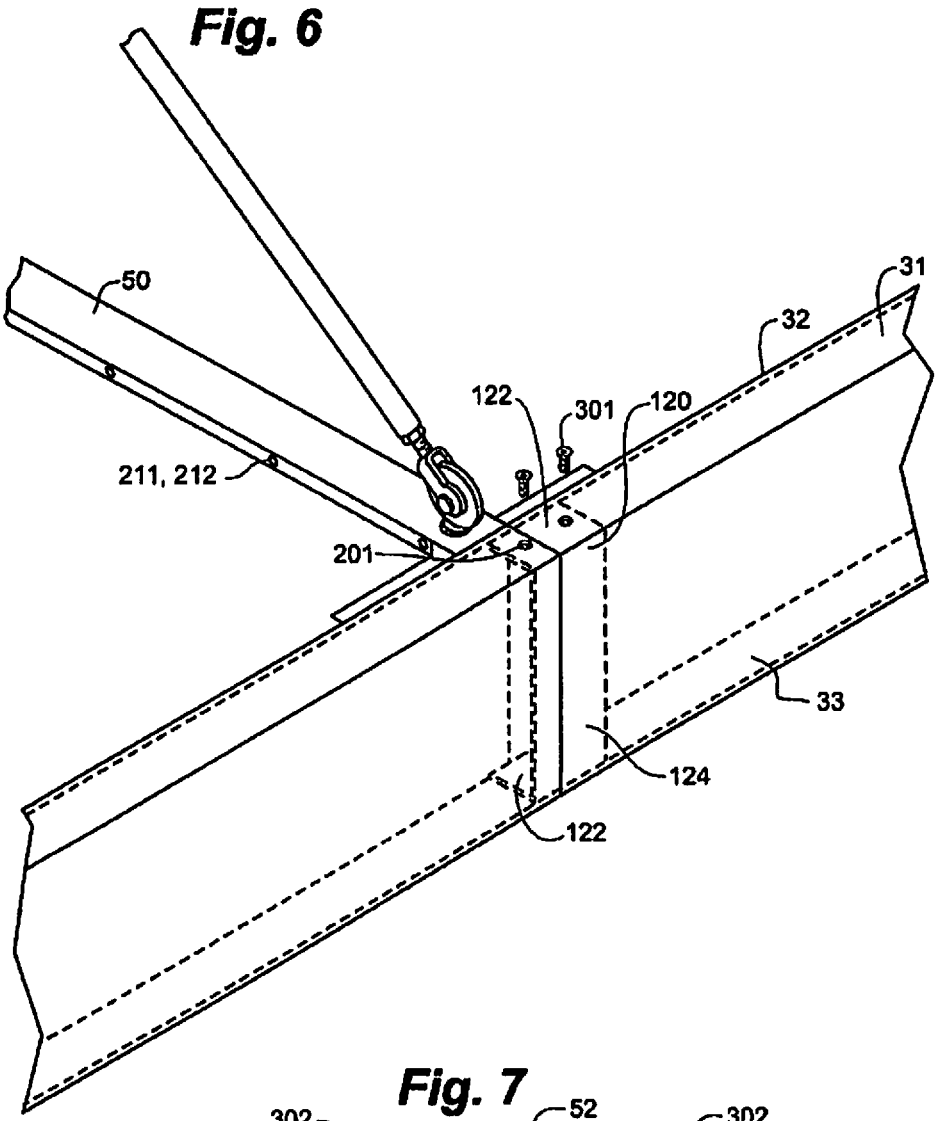
FIG. 6 shows a perspective view of a splice of two front tubes at a cross member with an attached turnbuckle.
Figure 7:
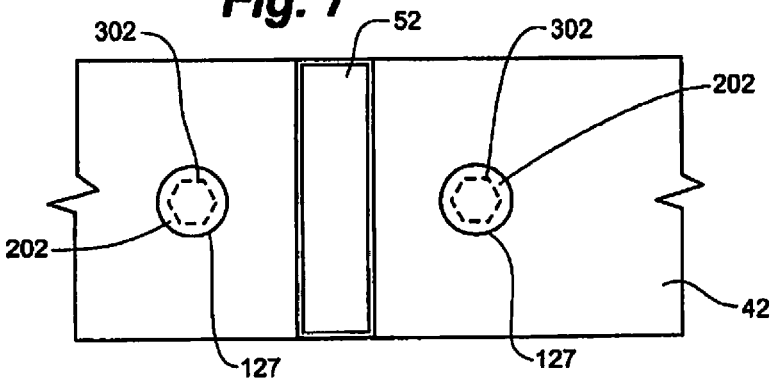
FIG. 7 shows a rear perspective view of a back tube at a junction with a cross member.
Figure 8A:
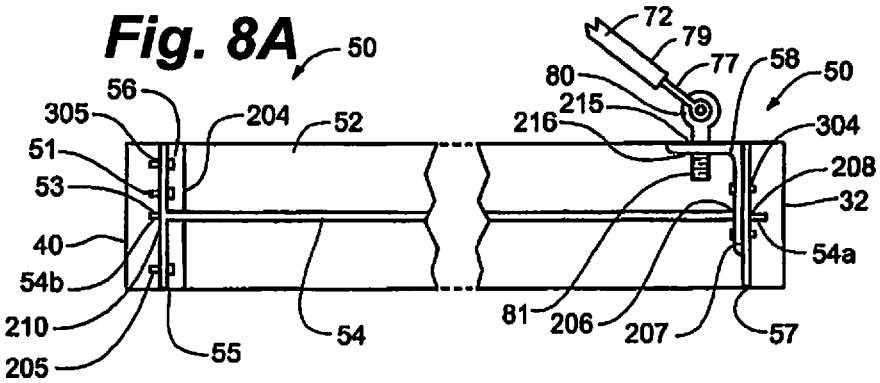
FIG. 8A shows a cross-sectional view of a cross member with the threaded rod.
Figure 8B:
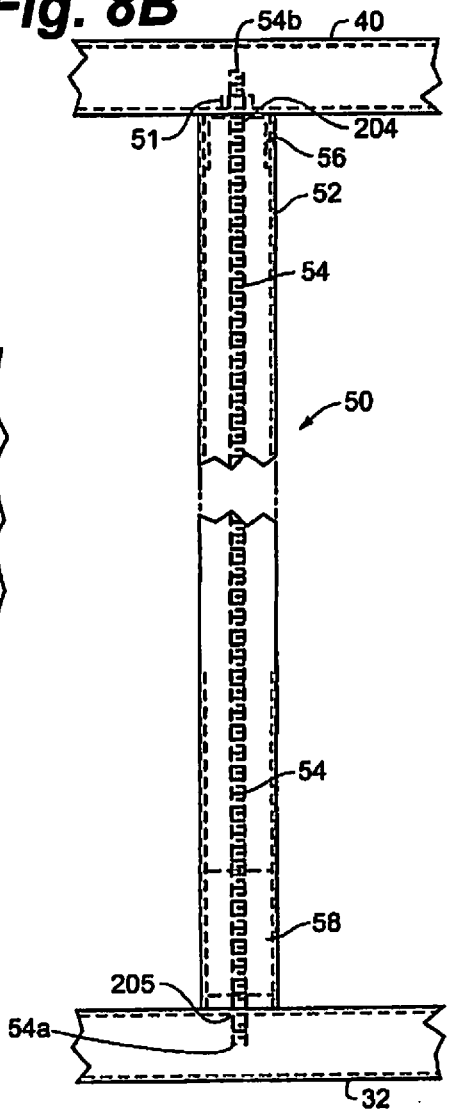
FIG. 8B shows a top planar view of a cross member, with the rod showing.
Figure 8C:
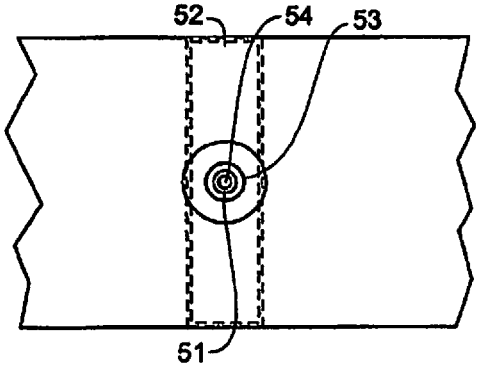
FIG. 8C shows a rear perspective view of the cross member, with the rod end, nut and washer showing.
Figure 9A:
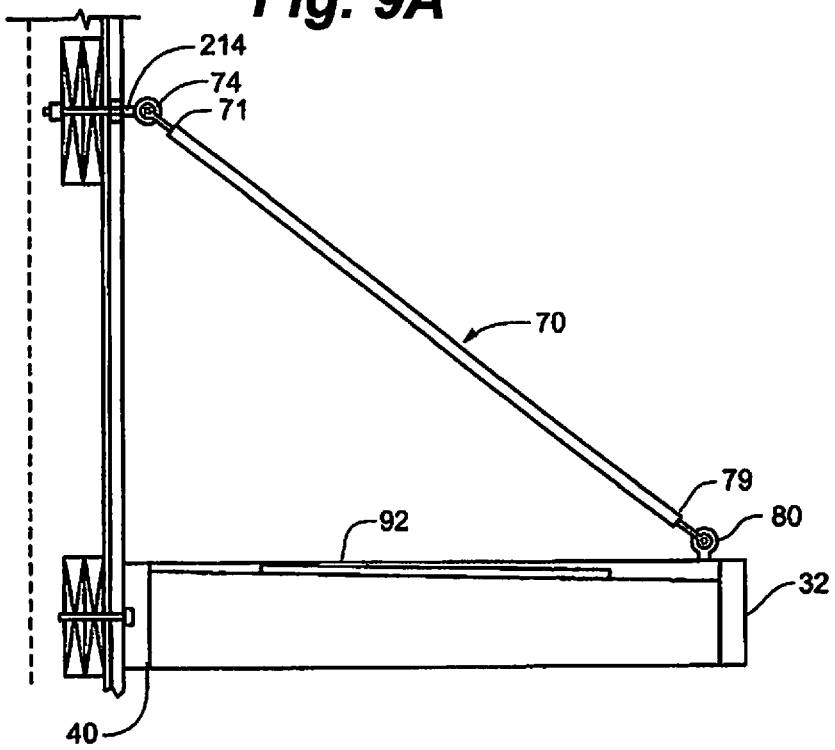
FIG. 9A shows a side perspective view of a trellis, with the turnbuckle attachments showing.
Figure 9B:
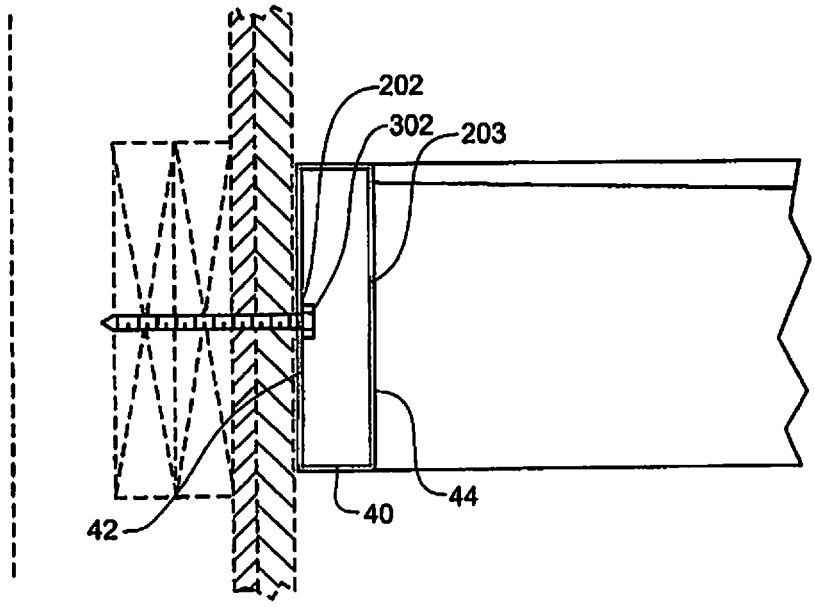
FIG. 9B shows a side perspective of an attachment of the trellis to a wall.
Figure 10:
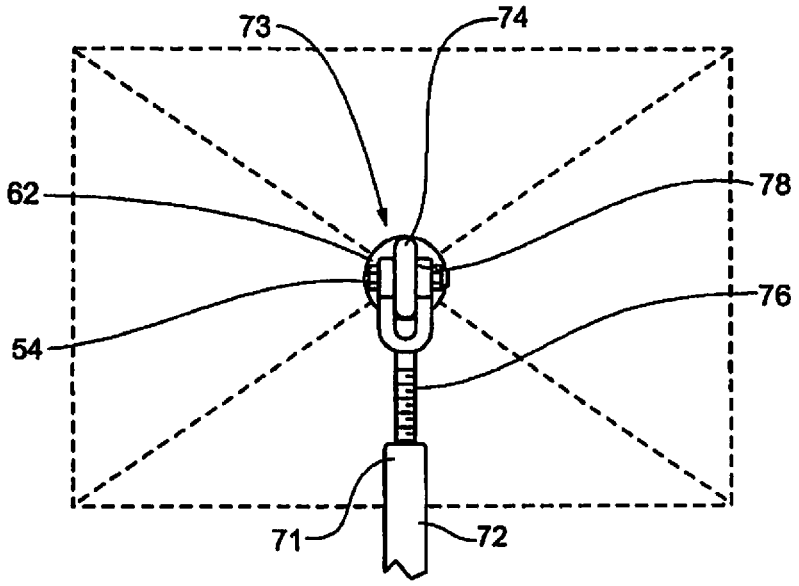
FIG. 10 shows a perspective view of a turnbuckle attachment to a wall.
Figure 11:
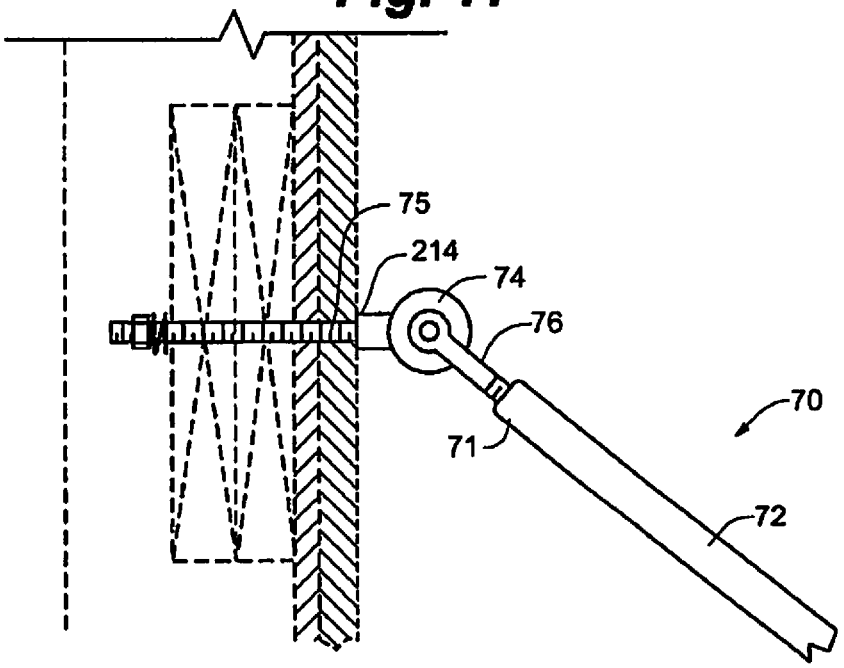
FIG. 11 shows a side perspective view of a turnbuckle attachment to a wall.
Figure 12:
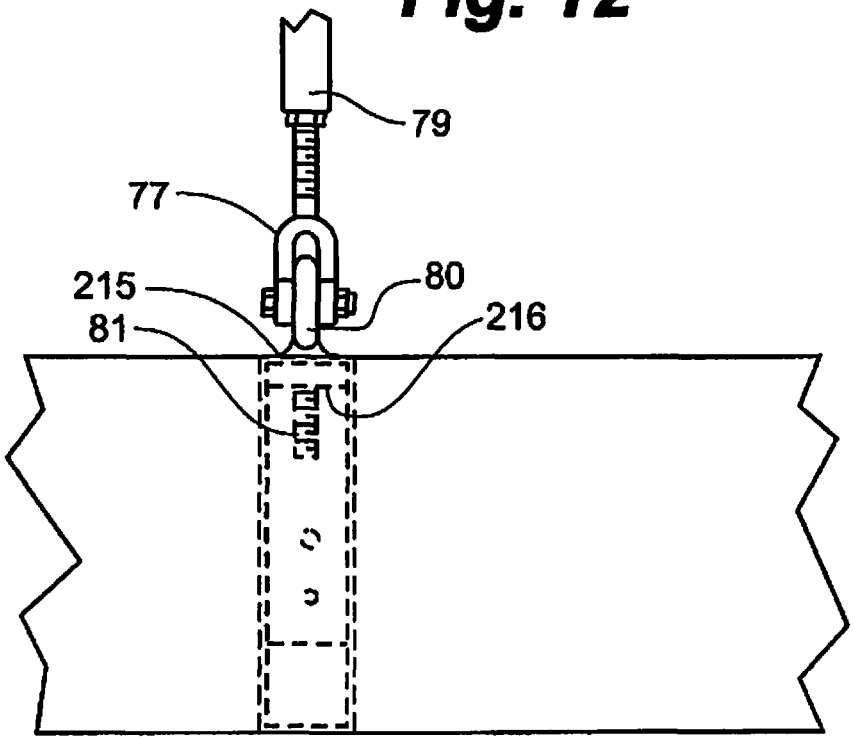
FIG. 12 shows an end perspective view of a turnbuckle attachment to a cross member at the front tube.
Figure 13:
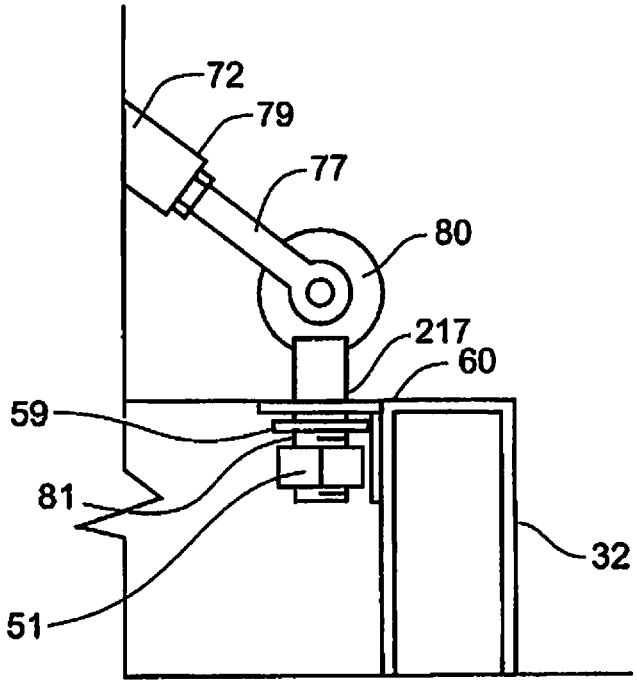
FIG. 13 shows a side perspective view of a turnbuckle attachment to a front tube.

The back tube 40, front tube 32 and end tubes 36 are adapted to interconnect to form a frame 30 encompassing the in-fill panels 90. Generally, the desired frame 30 is rectangular shaped, however a square shape frame can also be constructed. The back tube 40 and the front tube 32 are each constructed from one long tube, respectively, dependent upon the size of the frame 30 required. Front tubes 32 and back tubes 40 are generally fabricated in 24 foot lengths. If longer trellises 20 are needed, then multiple front tubes 32 and multiple back tubes 40 are spliced together to achieve the desired length. Shorter front tubes 32 and back tubes 40 can also be fabricated. Generally, the end tubes 36 are fabricated of sufficient length to not require more than one tube 36 to form the end tube structure. The end portions of the front tube 32, back tube 40, and end tubes 36 are configured to receive a splice sleeve 120. In one embodiment, as shown in FIGS. 5A, 5B and 6, the splice sleeve 120 is substantially U-shaped, with the two parallel legs 122 connected by a planar segment 124. The splice sleeve 120 is configured to be abuttingly engageable with the interior surfaces of the end portions of a back tube 40, end tube 36 or front tube 32; the legs 122 of the splice sleeve 120 abuttingly engageable with a top 31, 41, 35, and a bottom surface 33, 43, 37, respectively, of a tube. The surface of at least one of the legs 122 of the splice sleeve 120 defines at least two apertures 201, each adapted to receive a fastener 301. The fastener 301 includes, but is not limited to a flat head screw, a rivet, a weld, but preferably a flat head screw. The back tube 40 further defines a plurality of apertures 202 in the distal back tube surface 42 adapted to receive fasteners 302, and a plurality of apertures 203 in the back tube proximate surface 44 adapted to receive a tool, for example, a ratchet wrench. A distal tube surface refers to the exterior surfaces of the tube, facing a building or on the exterior of the trellis 20; a proximate tube surface refers to an internal surface of a tube, facing the in-fill panels 90.

As shown in FIGS. 3A, 3B, 4, 8A, 8B, and 8C, the trellis 20 comprises a plurality of cross member assemblies 50; however, only one of the cross member assemblies 50 is described, as the other cross member assemblies 50 are similar in structure. The cross member assembly 50 includes a tube 52, a threaded rod 54, a channel shear block 56, a nut 51 and washer 53, and a support angle 58. The threaded rod 54 extends through the interior of the cross member tube 52, the length of the cross member tube 52. Preferably, a cross-section of the cross member tube 52 is rectangular shaped, however other quadrilateral shapes can be used to accommodate surrounding geometry. The interior of the cross member tube 52 is adapted to receive a channel shear block 56 at one end 55 portion of the cross member tube 52 and a support angle 58 at the other end portion 57 of the cross member tube 52. The channel shear block 56 and the support angle 58 each define at least two apertures 204, 206 and 205, 206, in a surface of the channel shear block 56 and in a surface of the support angle 58, respectively, wherein one aperture 204, 206 is adapted to receive an end of the threaded rod 54 and the second aperture 205, 207 is adapted to receive a fastener 305, 307. Fasteners 305, 307 include, but are not limited to a flat head screw, a rivet, a weld, a Phillips pan head self drilling fastener, a hex head self-threading fastener, and the like. Preferably fastener 305 is a Phillips pan head self-drilling fastener and fastener 307 is a hex head self-threading fastener. One end 55 of the cross member 50 is abuttingly engageable with the back tube 40 and the opposite end 57 of the cross member 50 is abuttingly engageable with the front tube 32. Further, an aperture 208 in the proximate surface of the front tube 32 is configured to receive a first end of the threaded rod 54*a*, and an aperture 210 in the proximate surface of the back tube 40 is configured to receive a second end 54*b* of the threaded rod. A securing device, for example, a nut 51 and washer 53, is engageable with end of the threaded rod end 54*b* proximate the back tube 40.

Figure 14:
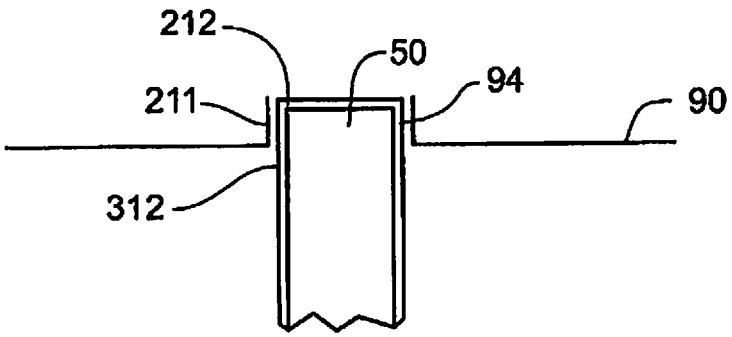
FIG. 14 shows an end perspective view of an in-fill panel attached to a cross member.
Figure 19:
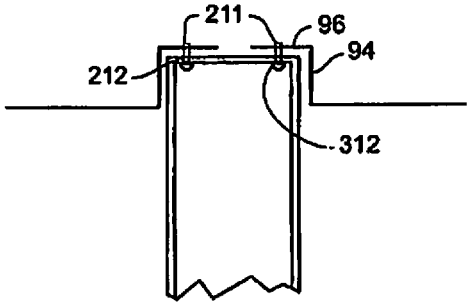
FIG. 19 shows a perspective view of an alternative structure and joining of an in-fill panel to a cross member.
Figure 20:
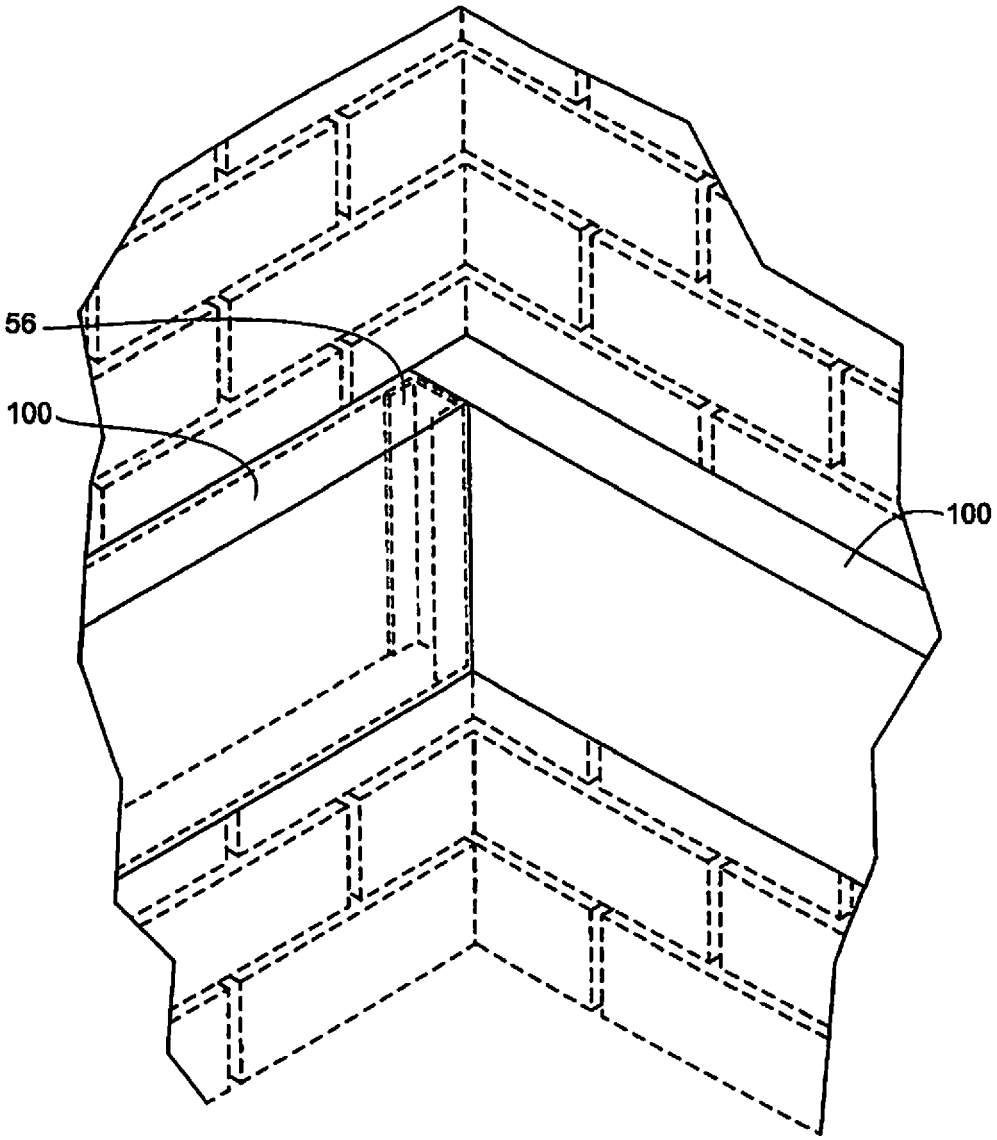
FIG. 20 shows a perspective view of two accent bands joined at a building interior corner.
Figure 21:
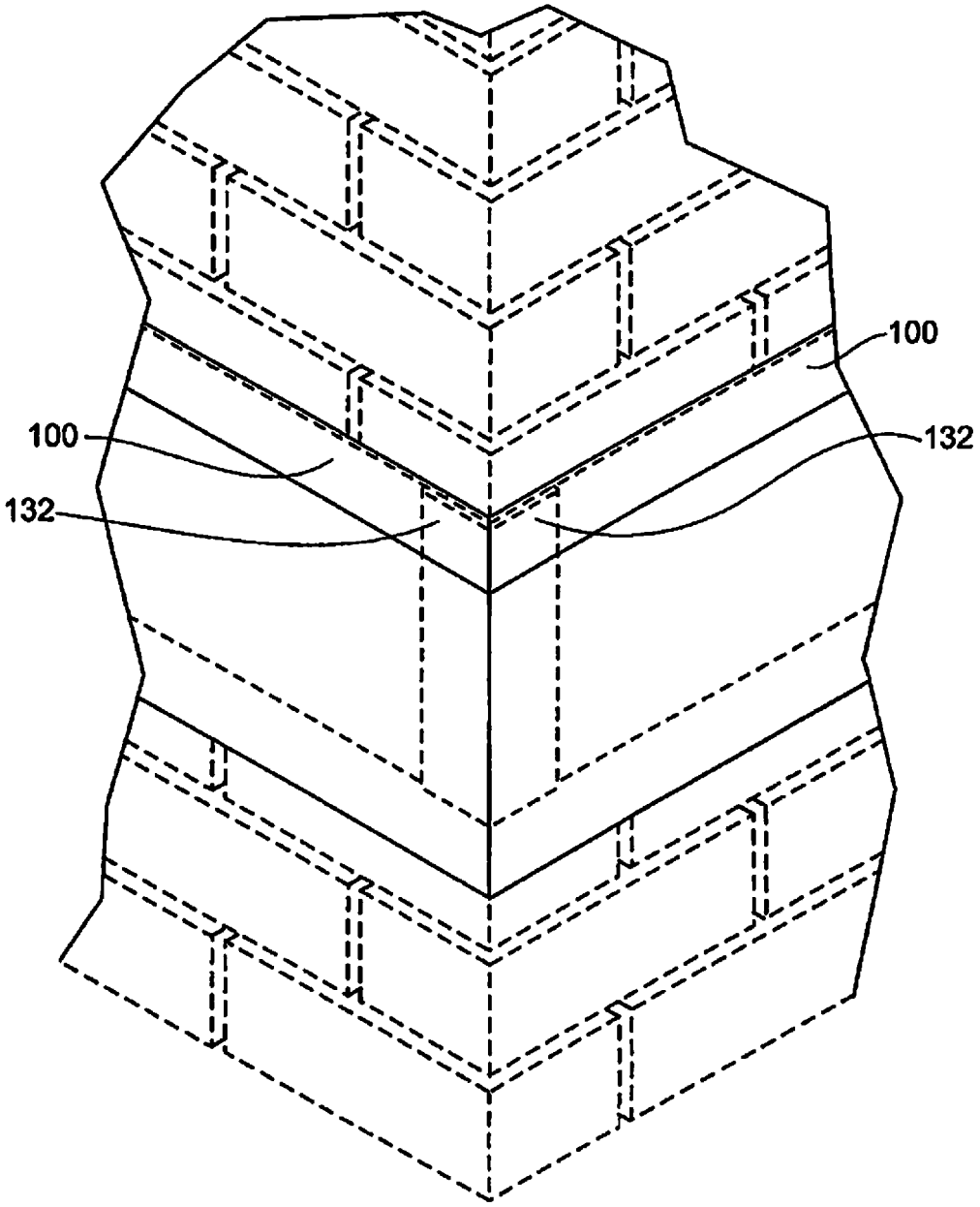
FIG. 21 shows a perspective view of two accent bands joined at a building exterior corner.
Figure 22:
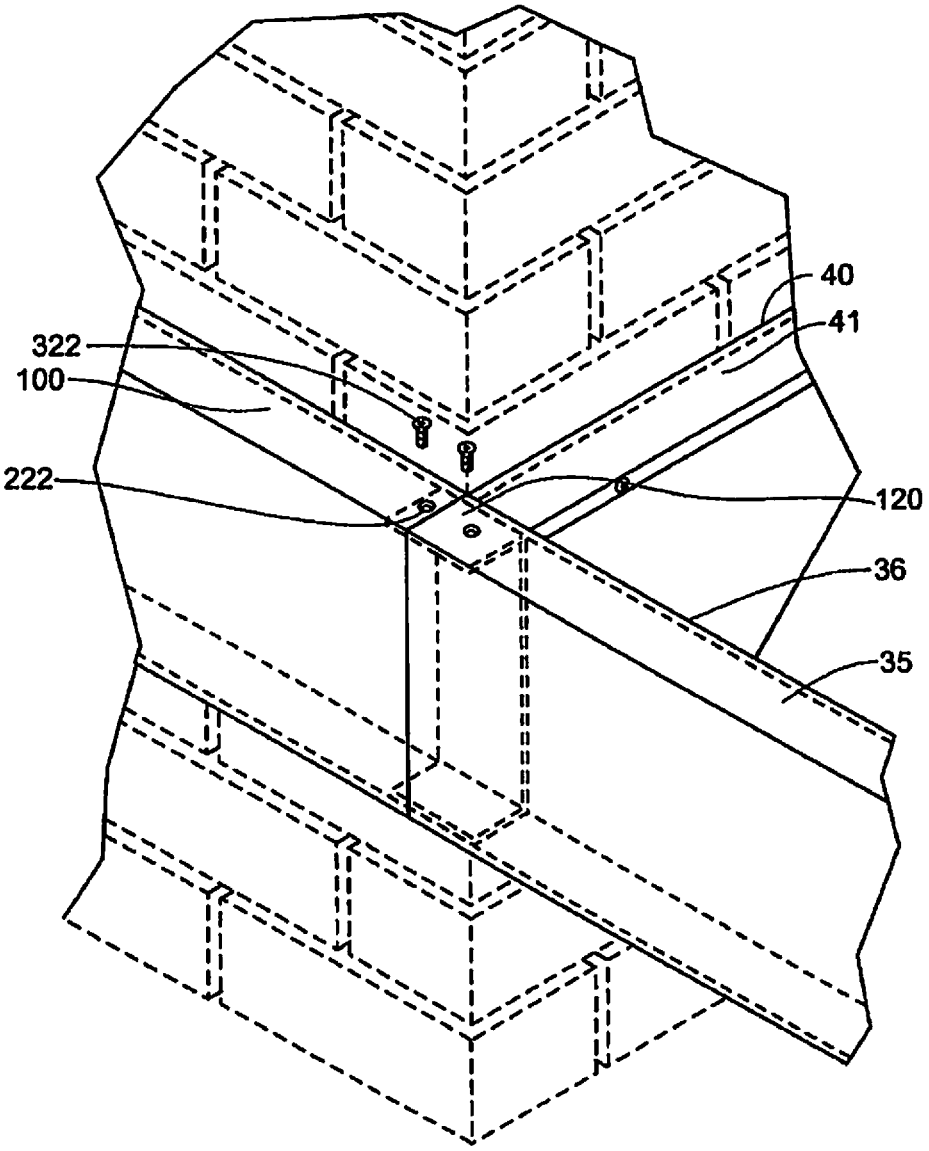
FIG. 22 shows a perspective view of a joining of an accent band, back tube, and end tube, at a building corner.

Referring to FIGS. 3*b*, 14 and 19, the roof 88 of the trellis 20 is formed by in-fill panels 90 which are affixed to the frame work 30 of the back tube 40, the front tube 32 and the end tubes 36. The in-fill panels 90 are also affixed to the cross members 50. Each in-fill panel 90 includes a lip or flange structure 94 along the perimeter of the in-fill panel 90. The flange structure 94 defines a plurality of apertures 211 configured to align with apertures 212 drilled in the proximate surfaces of the tube 32, 40, 36 and cross members 50 such that the aligned apertures 211, 212 are positioned to receive fasteners 312. The fasteners 312 can be rivets, nails, screws, welds, or the like. Preferably, flat head screws or rivets are used. Alternatively, the in-fill panel 90 perimeter can include a lip or flange 94 connected to a horizontal leg 96, the horizontal leg 96 parallel to the in-fill panel 90, such that the horizontal leg 96 is abuttingly engageable and adapted to be affixed to the top surface of the cross member 50 and to the top surface 31, 41, 37, of the front tube 32, back tube 40 and end tubes 36. The fasteners 312 affixing the in-fill panels 90 to the cross members 50 and to the tubes 32, 40, 36 are not visible from below the trellis 20.

As shown in FIGS. 3A and 4, the top surface 91 of the in-fill panels 90 includes a plurality of spaced stiffeners 92. The stiffeners 92 are oriented parallel to the cross members 50, in between the cross members 50. The stiffeners 92 can be variously shaped. In a preferred embodiment, the stiffeners 92 are shaped hat channels 93, wherein the horizontally planar portion 96 of the hat channel 93 is preferably adhered to the top surface 91 of the in-fill panel 90. Preferably, the planar portion 96 of the hat channel 93 is adhered to the top surface 91 of the in-fill panel 90, with an industrial adhesive. The addition of stiffeners 92 is optional, and is generally added to trellises in northern and coastal regions that must withstand the weight of snow and/or updrafts.

Referring to FIGS. 3B, 8A, 9A, 10, 11, 12, and 13, the attachment assembly 70 comprises a turnbuckle 70 that includes a metal pipe 72, a shoulder eyebolt 74 coupled to a left-handed threaded jaw 76, wherein the left-handed threaded jaw 76 is threadingly engaged with a first end portion 71 of the metal pipe 72. Preferably, the metal pipe 72 is a steel metal pipe 72, preferably a galvanized or painted steel pipe. The shoulder eyebolt coupling 73 with the left-handed threaded jaw 76 includes a rubber spacer 78 such that any noise caused by the interaction of the eyebolt 74 and the left-handed threaded jaw 76 is reduced. The eyebolt 74 is configured to be received in an aperture 214 drilled through the building surface and affixed to the underlying structure of the building. The turnbuckle 70 further includes a right-handed jaw 77 threadingly engaged to the second portion 79 of the steel pipe opposite the first end portion 71. An eyebolt 80 is adapted to receive the right-hand threaded jaw 77, the eyebolt 80 presenting a shaft 81 engageable with a top surface of the trellis 20. In one alternative, the eyebolt shaft 81 is coupled to a cross member 50, wherein an aperture 215 in the cross member 50 is aligned with an aperture 216 in a support angle 58 positioned in the interior of the cross member 50, and the apertures 215, 216 are configured to receive the threaded shaft 81 of the eyebolt 80. Further, the support angle 58 includes at least one other aperture 207, the aperture 207 configured to receive a fastener 307 affixing the support angle 58 to the proximate surface of the front tube 32. Fastener 307 includes, but is not limited to a flat head screw, a rivet, a weld, a hex head self-threading fastener, and the like. Preferably fastener 307 is a hex head self-threading fastener. In another alternative, the in-fill panel 90 includes a plate on the top surface of the in-fill panel 90, the plate defining an aperture 217 configured to receive the threaded shaft 81 of the eyebolt 80. Here, too, a support angle 58 is positioned on the proximate surface of the front tube 32.

Figure 17:
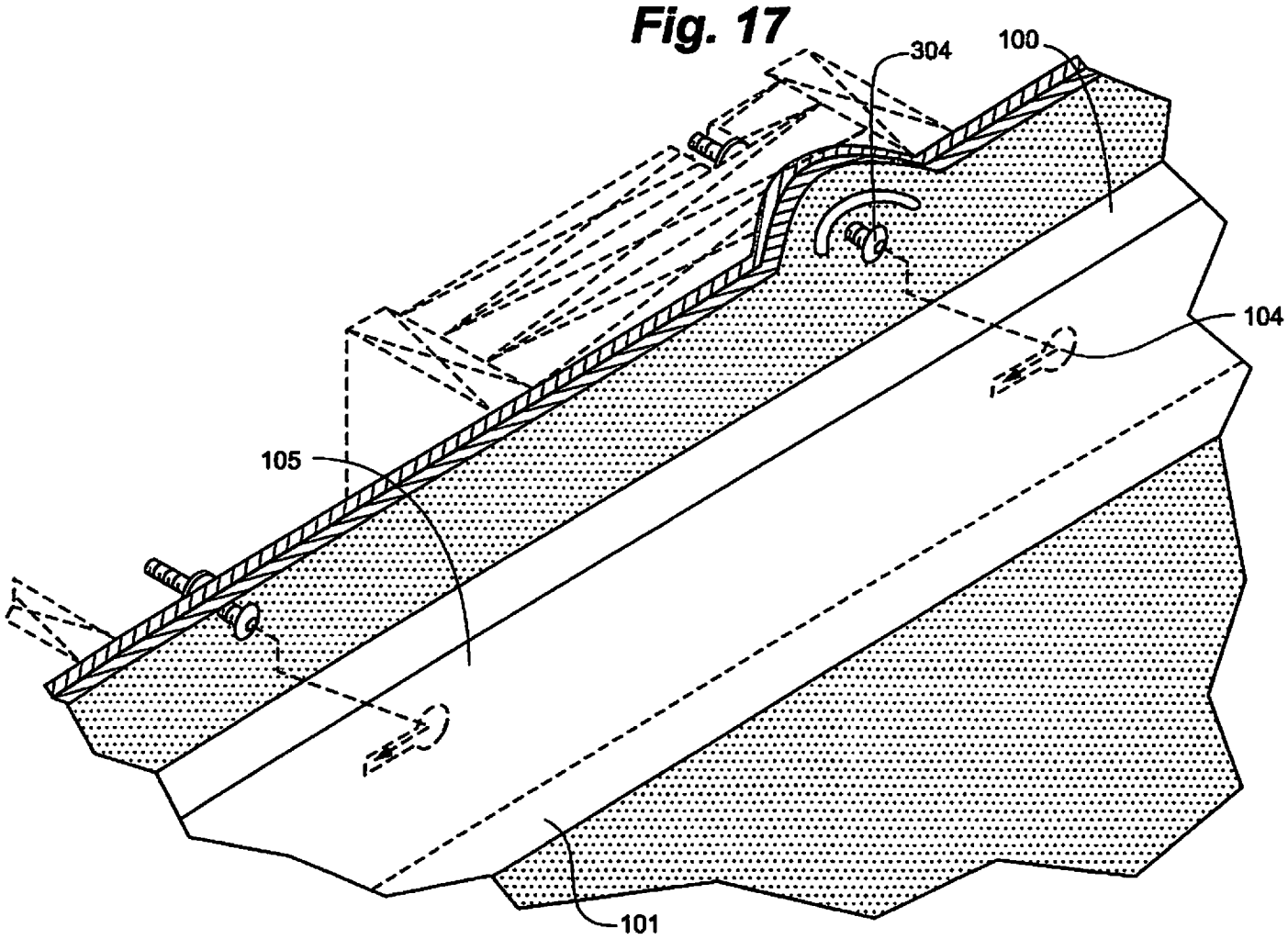
FIG. 17 shows a perspective view of an accent band and attachment.

The accent bands 100 comprise a plurality of bands 100 designed to provide an aesthetically pleasing finished appearance to the building exterior, proximate the installed trellis 20. One or a plurality of accent bands 100 can be used, dependent upon the given circumstances of, for example, design and size of the building, as demonstrated in FIGS. 3A and 4. An accent band 100 comprises a tube 101, generally with a rectangular cross-section; however, other quadrilateral shapes can be used, dependent, at least in part, on surrounding geometries. Referring to FIG. 17, the distal face 105 of the tube 100 includes a plurality of keyhole slots 104 adapted to receive the head of a fastener 304 affixed to the wall of the side of the building. The fastener 304 affixed to the side of the building can include, but not be limited to, a screw, a nail, a bolt, or a weld. Preferably the fastener 304 is a carriage bolt or the like. Alternatively, the accent band 100 can have a C-shaped cross-section, with two parallel legs 108 connected to one another by a planar segment 110, as shown in FIG. 18. The two legs 108 further include a flange 112, wherein the flange portion 112 is positioned parallel to the planar segment 110, the two flange portions 112 extending toward each other. The accent band 100 further includes an anchor plate 106 positioned in the interior of the accent band 100, a horizontal top segment 107 of the anchor plate 106 abuttingly engageable with the top leg 108 of the accent band 100, and an orthogonally contiguous segment 109 of the anchor plate 106 abuttingly engageable with the top flange 112 of the anchor band 100. The orthogonal contiguous segment 109 of the anchor plate 106 forms a lip 111 and a lower portion 114 of the anchor plate extends substantially orthogonally to the lip 111. The lower portion 114 of the anchor plate 106 is configured to be positioned flush against the wall of the side of the building and defines at least one aperture 218 adapted to receive a fastener 318 and affix the anchor plate 106 to the wall of the building. The fastener 318 includes, but is not limited to a screw, a bolt, a nail, a weld, or a rivet; and is preferably a wood screw. Other configurations for an anchor plate 106 can be used with the accent band 100, the anchor plate 106 designed to accommodate the shape of the accent band 100.

Figure 23:
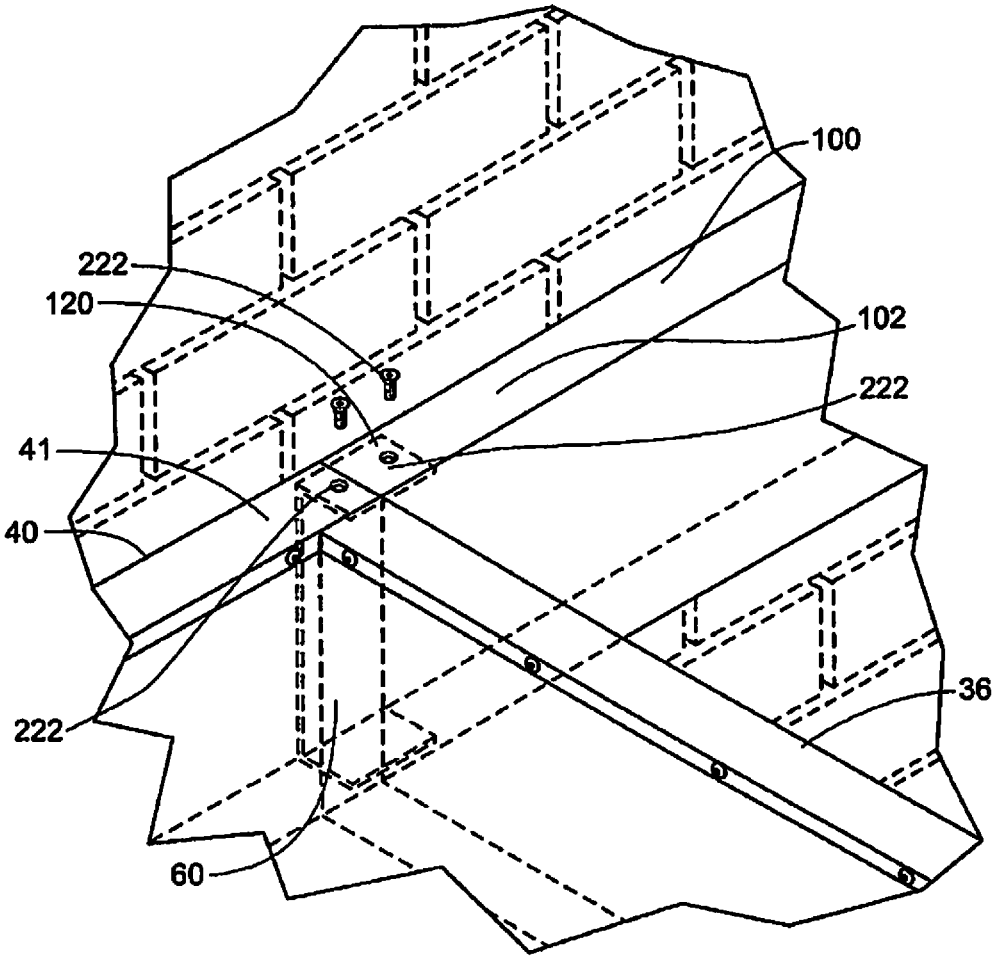
FIG. 23 shows a perspective view of a joining of an accent band and end tube.

The accent bands 100 can be linked together with each other, along the walls of the building, and can also be linked with the back tube 40 and/or the end tubes 36, dependent upon the final configuration of the trellis system 10. FIGS. 20-23 show various connections of accent bands and, in some instances, a back tube 40 and end tube 36. Using a splice sleeve 120, as described above, the accent bands 100 can be spliced to one another, to the back tube 40 and/or the end tubes 36, resulting in a hairline joint. An example of a splice of the back tube 40 and an accent band 100 is shown in FIG. 23. For turning corners, a shear block 56 can be affixed to a first accent band 100, and the second accent band 100 fits over the shear block, the second accent band 100 positioned orthogonally to the first accent band 100.

The trellis 20 can be preassembled away from the installation site, or the trellis 20 can be assembled on site. Generally the trellis is assembled by joining a plurality of in-fill panels 90, a back tube 40, a front tube 32, end tubes 36, cross members 50, and attachment assemblies 70. Pre-assembling the trellis 20 away from the installation site is generally more cost efficient and time efficient, because, for one reason, the same crew can gain experience in assembling the trellis 20 and has the required tools at hand. The in-fill panel sections 90 generally come in 4 ft.×6 ft. sections and the final length of the trellis 20 is generally 24 ft. However, the in-fill panels 90 and the trellis 20 can be fabricated in other sizes. The 4 ft.×6 ft. in-fill panels, with a total trellis length of 24 ft., are presented as an example. A further example of a 48 ft. trellis 20 is presented to illustrate splicing two sections of the trellis 20 together, forming one hairline joint.

Figure 24:
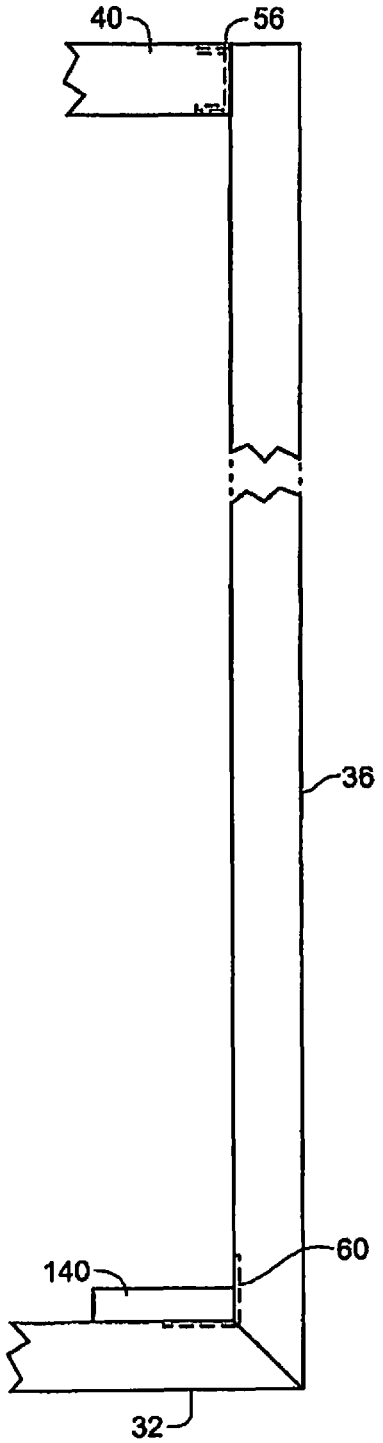
FIG. 24 shows a top planar view of the junction of the back tube with an end tube, and a front tube with an end tube.

In operation, a back tube 40 is attached to a first end of an end tube 36 of the trellis 20 and a front tube 32 is attached to a second end of an end tube 36 of the trellis 20, as shown if FIG. 24. In this example, the front tube 32 and the back tube 40 are each 24 feet long. A shear block 56 is affixed to an end surface of the back tube 40 and the first end of the end tube 36 is slidingly engaged over the shear block 56 and the end tube is affixed to the shear block 56 by fasteners 318. The fasteners 318 are metal fasteners 318, for example, rivets, bolts, nails, screws, or a weld. Preferably, the fasteners 318 are flat head screws. The second end of the end tube 36 is affixed to an angle plate 60, wherein one leg of the angle plate 60 abuts the interior surface of the proximate face of the end tube 32 and the other leg of the angle plate 60 abuts the interior surface of the proximate face 34 of the front tube 32. The angle plate 60 is fastened to the front tube 32 and the end tube 36 using fasteners 320. The fasteners 320 are metal fasteners 320, for example, rivets, bolts, nails, screws, or a weld. Preferably, the fasteners 320 are flat head screws. A hairline joint is formed between the back tube 40 and end tube 36, and the front tube 32 and end tube 36, and no fasteners 318, 320 are visible on the exterior surfaces of the trellis 20.

A first end 55 of a cross member 50 is affixed to the back tube 40 and a second end 57 of the cross member 50 is affixed to the front tube 32. A first end 54*b* of the threaded rod 54 in the first end 55 of the cross member 50 extends through a shear block plate 56 and then into the back tube 40 interior. A nut 51 and washer 53 are threaded on the end of the threaded rod 54*b*. A second end 54*a* of the threaded rod 54 extends through an angle plate 58 and into the front tube 32 interior. When the trellis 20 structure is complete, the nut 51 on the threaded rod 54 is tightened, thereby fixing the front tube 32 and back tube 40 together. Access to the nut 51 is gained through apertures 202 in the distal face 42 of the back tube 40.

The turnbuckles 70 are affixed to the trellis 20 either through a plate affixed to the surface of an in-fill panel 90 or to a cross member 50. The shoulder eyebolt 80 at one end 79 of the turnbuckle 70 is threaded through an angle plate 58 in the interior of the cross member 50. A lock washer 59 and nut 51 are threaded onto the eyebolt shaft 81 and tightened, thereby fixing the eyebolt 80 in place. Alternatively, the shoulder eyebolt 80 is affixed to a plate on the surface 91 of an in-fill panel 90. And angle plate 60 is affixed to the proximate surface of a front tube 32. A lock washer 59 and a nut 51 are threaded onto the eyebolt shaft 81 and tightened, thereby fixing the eyebolt 80 in place. Thread lock can be used on the threads. The opposite end 71 of the turnbuckle 70 is not affixed to the building wall until the trellis 20 is completed.

A plurality of stiffeners 92, in particular, hat channels 93, is adhered to each in-fill panel 90, using an industrial adhesive. Such adhesives are available from various adhesive companies, for example, Lord Corporation of North Carolina. In a preferred embodiment, four hat channels 93 are spaced apart and adhered to the top surface 91 of an in-fill panel 90. The hat channel 93 generally does not extend the entire width of the in-fill panel 90.

Figure 15:
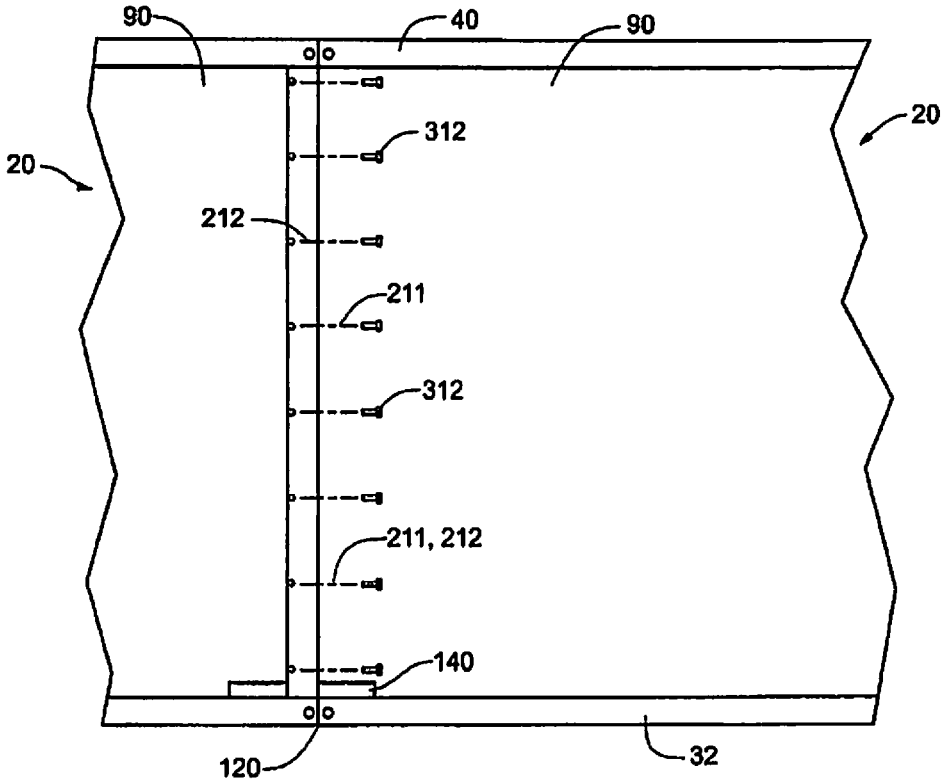
FIG. 15 shows a top planar perspective of two trellis panels spliced together at a cross member.
Figure 16:
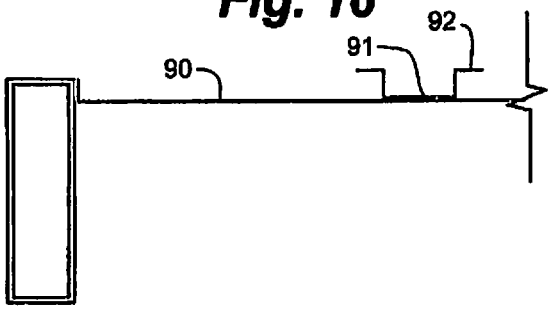
FIG. 16 shows an end perspective view of a hat channel adhered to an in-fill panel.

The in-fill panel 90 is affixed to the front tube 32, back tube 40, cross member 50 and end tube 36, if the in-fill panel 90 is an end panel. The lip 111 of the perimeter of the in-fill panel 90 abuttingly engages the inner (proximate) surfaces of the front tube 32, back tube 40, end tube 36 and cross member 50, and fasteners 312 are used to affix the in-fill panel lip 111 to the front tube 32, back tube 40, end tube 32 and cross member 50. Metals fasteners 312, for example, screws, bolts, welds, rivets, can be used, and preferably flat head screws or rivets are used to affix the in-fill panel 90. Each in-fill panel 90 is similarly affixed to the front tube 32, back tube 40 and cross member 50, the length of the trellis 20. If a longer trellis 20 is required, beyond the longest standard length, for example, longer than 24 feet, two pre-assembled segments of the trellis 20 are mated to obtain the longer length, as shown in FIG. 15. Two sections of the trellis 20 are brought together forming a hairline joint. A trellis splice sleeve 120 is fastened to the two segments of the trellis 20; one splice sleeve 120 joining the two front tubes 32, and one splice sleeve joining the two back tubes 40. Using the apertures 211 in the in-fill panel 90 as a guide, holes are drilled in the cross member tube 52 of a first section of trellis 20 and the in-fill panel 90 of the second section of trellis 20 is affixed to the cross member tube 52 of the first section of trellis 20. Only a hairline joint shows in the exterior of the trellis.

Once the in-fill panels 90 are affixed to the back tube 40, front tube 32, cross members 50, and end tubes 36 when an end panel, the unattached end 71 of the turnbuckle 70 can be affixed to the building. The shaft 75 of the eyebolt 74 is inserted through an aperture 214 drilled into the wall. The shaft 75 of the eyebolt 74 is passed into the aperture 214, to the wood blocking of the wall. A flat washer 62 and lock washer 59 and nut 51 are threaded on the end of the eyebolt shaft 75 and the second end 71 of the turnbuckle 70 is affixed to the building. The left jaw 76 and right jaw 77 structure of the turnbuckle 70 facilitates turning the turnbuckle 70 to the right or to the left to level the trellis 20, lifting or lowering the trellis structure.

Accent bands 100 can be added to the building exterior to complete an aesthetically pleasing appearance. An accent band 100 added to the building face adjacent the back tube 40 is connected to the back tube 40 by a splice sleeve 120, wherein the fastener 322 is positioned at the top 102 of the accent band 100/back tube 41 surfaces. A fastener 322, for example, a flat head screw, passes through aperture 222, and is used to fasten the accent band 100 and the back tube 40 to the splice sleeve 120. The fastener 322 can include, but not be limited to a bolt, screw, weld, or rivet. Further, the end tube 36 abuts to the hairline joint formed by the accent band 100 and back tube 40. An angle plate 132 connects two accent bands 100 around a corner of the building. One leg of the plate 132 abuts along the interior of the distal face of one accent band 100, and the other leg of the plate abuts along the interior of the distal face of the other accent band 100, and the fasteners affix each band 100 to the angle plate 132, such that the fasteners are not visible on the exterior of the accent bands.

As shown in FIG. 17, keyhole slots 104 positioned in the distal surface 105 of the accent band 100 are positioned over a fastener head 304, for example, a carriage bolt head, the bolt extending from the exterior of the building wall into the interior of the wall. A flat washer 62, lock washer 59 and nut 51 secure the carriage bolt to the building. Alternatively, the accent band 100 is affixed to the building exterior by use of an anchor plate 106. The anchor plate 106 is affixed to the exterior building wall by fasteners 318, for example, wood screws, and the accent band 100 is hung over an extending lip 107 of the anchor plate 106. The accent band 100 used with the anchor plate 106 is not a tube, but C-shaped with a flange 112 at each horizontal end 108 of the C-shape.

In another embodiment of the present invention, referring generally to FIGS. 25-35, a trellis system 400 is depicted. Trellis system 400 includes a trellis 402 and accent bands 404. Trellis 402 includes attachment assemblies 408 and a frame structure 30, cross member assemblies 50, and in-fill panels 90 as described in previous embodiments. Frame structure 30 comprises a fascia or front tube 32, a back tube 40 and end tubes 36, just as described in previous embodiments. In-fill panels 90 are operably coupled to cross member assemblies 50 as described in previous embodiments. Further, frame 30 encompasses in-fill panels 90 as described in previous embodiments.

Figure 25:
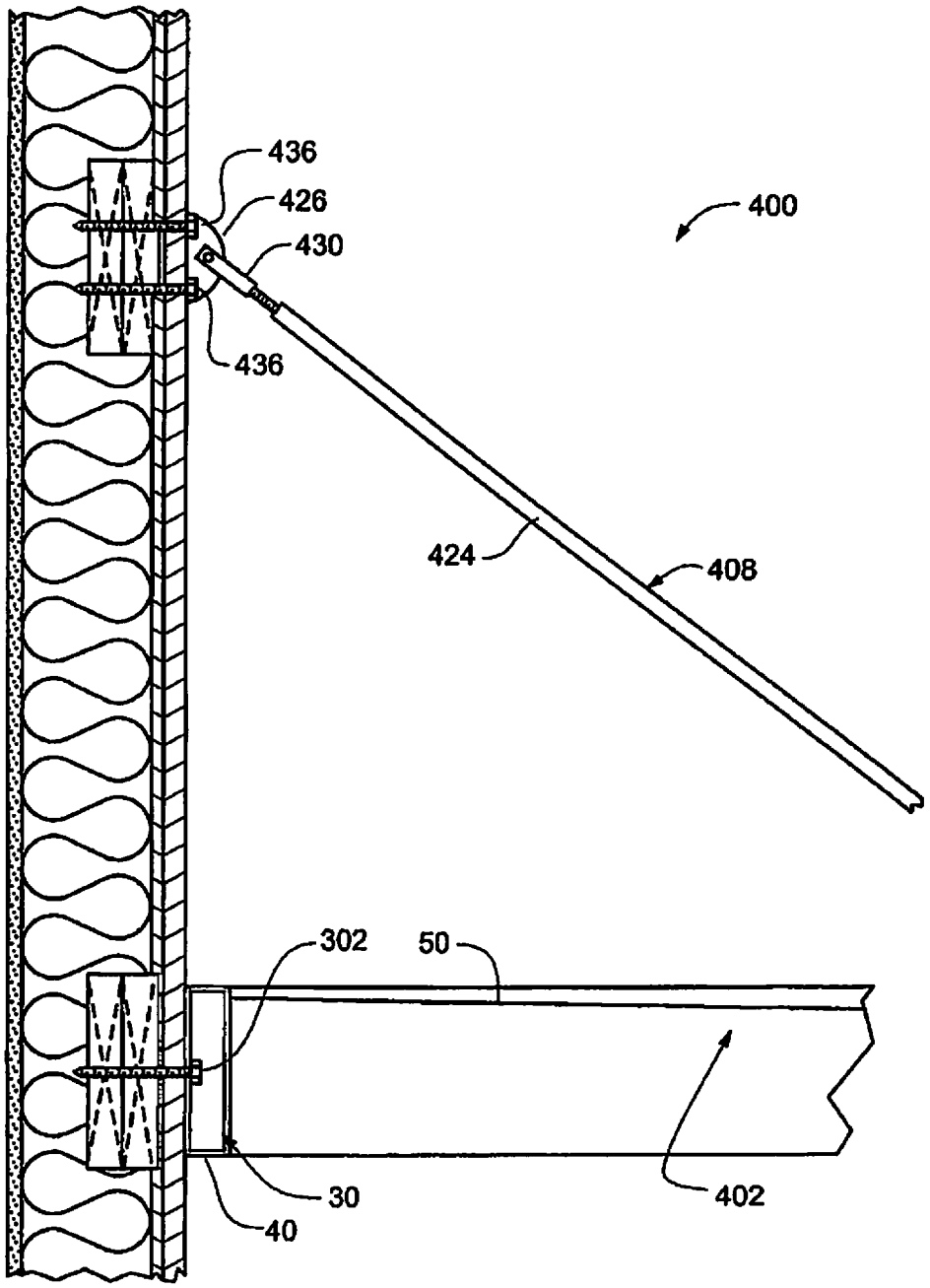
FIG. 25 shows a side perspective view of a trellis, according to an embodiment of the invention.
Figure 26:
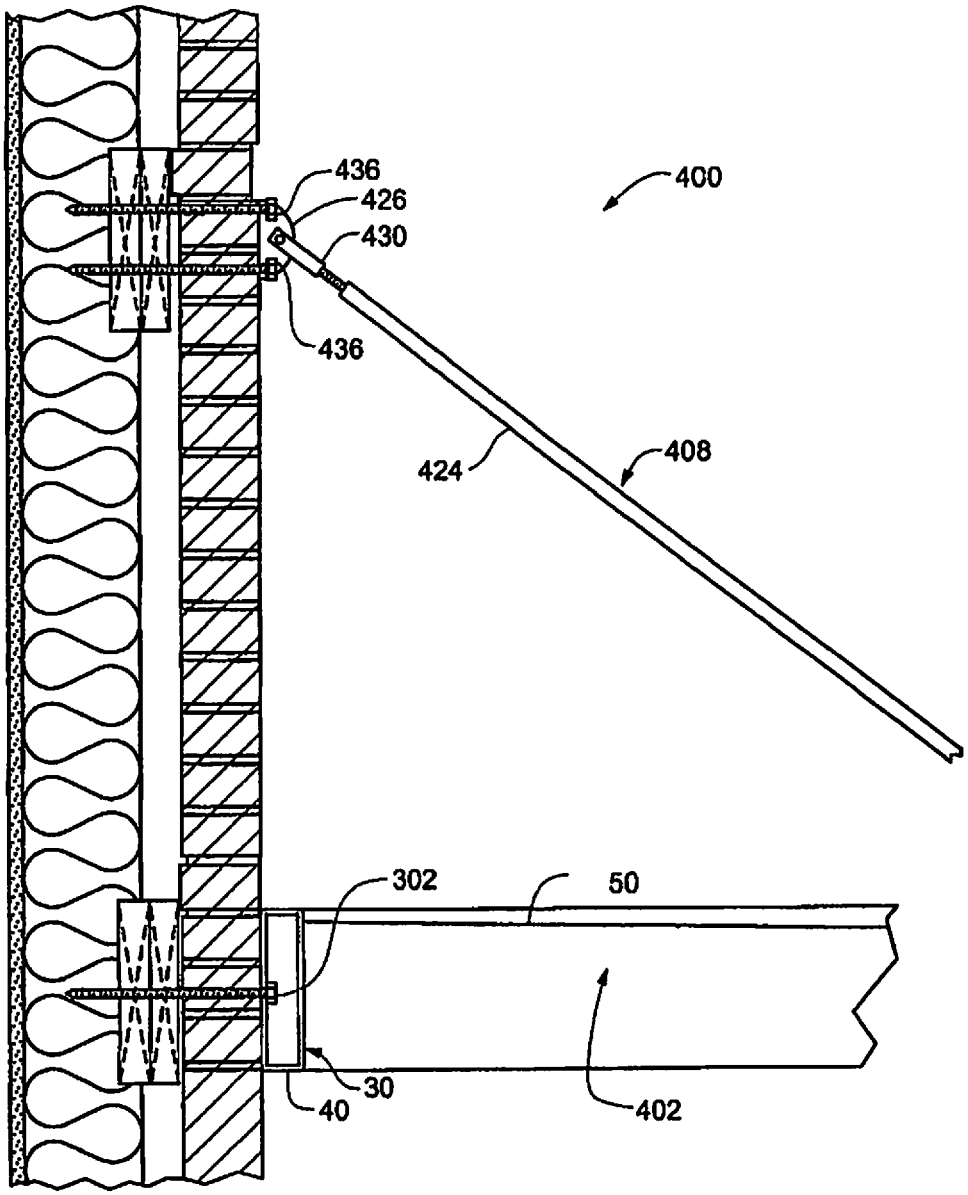
FIG. 26 shows a side perspective view of a trellis, according to an embodiment of the invention.
Figure 27:
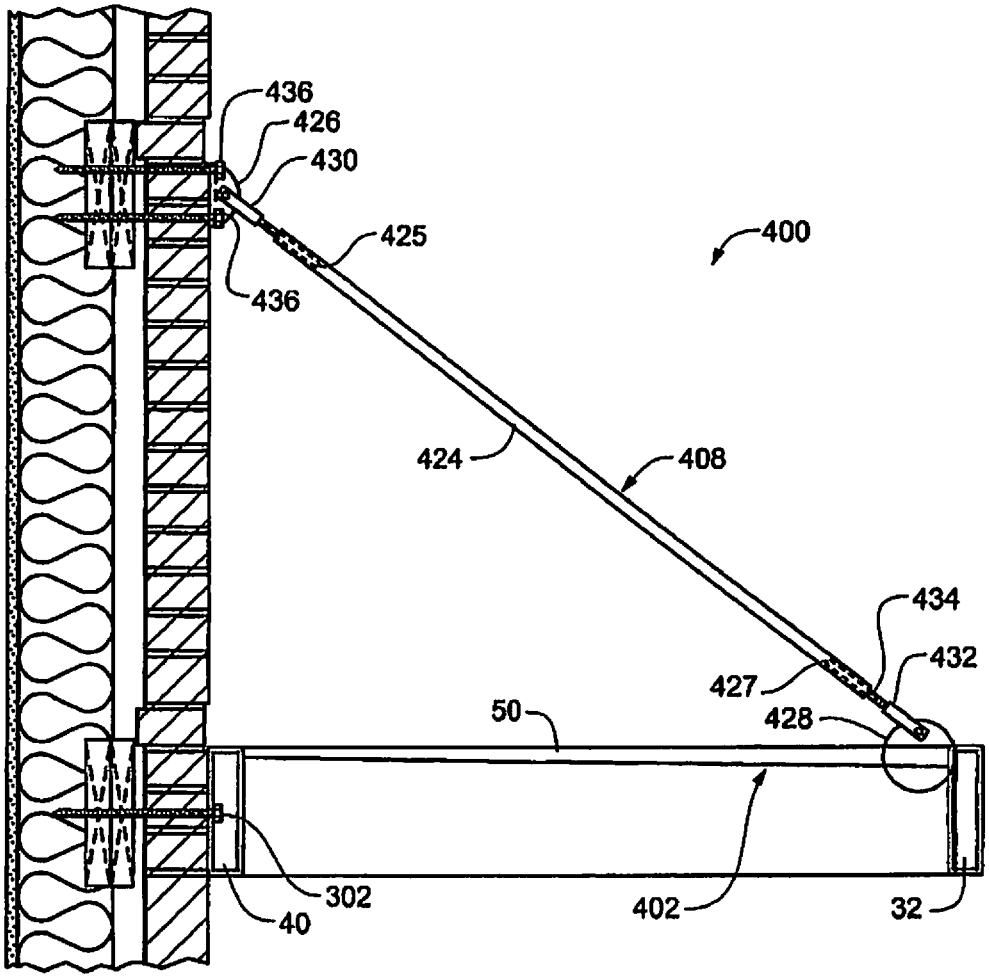
FIG. 27 shows a side perspective view of a trellis, according to the embodiment of FIG. 25.

Referring specifically to FIGS. 25-27, attachment assembly 408 comprises tieback rod 424, top anchoring clip 426, bottom anchoring clip 428, left-handed threaded stud 430, right-handed threaded stud 432, and nut 434. In an embodiment, tieback rod 424 is a galvanized or painted steel pipe. Top anchoring clip 426 is configured to be operably coupleable to the building surface via one or more fasteners 436. In one embodiment, as depicted in FIGS. 25-27, top anchoring clip 426 is substantially half-circle-shaped, wherein the flat side extends substantially parallel to the height of the building surface in a substantially vertical direction, and is secured by two fasteners 436 on opposite sides of top anchoring clip 426. In alternative embodiments, the flat side of top anchoring clip 426 extends in a substantially horizontal direction, and may be secured by one or more fasteners 436. In still alternative embodiments, top anchoring clip 426 may be substantially square or round and fastened appropriately. The shape or style of top anchoring clip 426 is not limited to the above-described embodiments.

A portion of top anchoring clip 426 is adapted to couple to left-handed threaded stud 430 at the curved end of top anchoring clip 426 distal the building surface. Tieback rod 424 is configured to receive a portion of left-handed threaded stud 430 distal the portion coupled to top anchoring clip 426. Accordingly at a first end 425 of tieback rod 424, a threaded shaft is presented. Likewise, at a second end 427 of tieback rod 424, a threaded shaft is presented such that tieback rod 424 is configured to receive a portion of right-handed threaded stud 432.

Similar to top anchoring clip 426, as depicted in FIG. 27, bottom anchoring clip 428 is substantially half-circle-shaped, wherein the flat side extends substantially parallel to the length of cross member 50. Instead of operably coupling to an eyebolt and eyebolt shaft as described in previous embodiments, cross member 50 is operably coupled to attachment assembly 408 via bottom anchoring clip 428 and appropriate fasteners on opposite sides of bottom anchoring clip 428. Further, bottom anchoring clip 428 is adapted to operably couple to right-handed threaded stud 432 in a manner similar to the coupling between top anchoring clip 426 and left-handed threaded stud 430. Nut 434 is designed to be threaded along right-handed threaded stud 432 and such that it abuts tieback rod 424 to provide an adjustable, secure length to vary the height of trellis 402.

Figure 37:
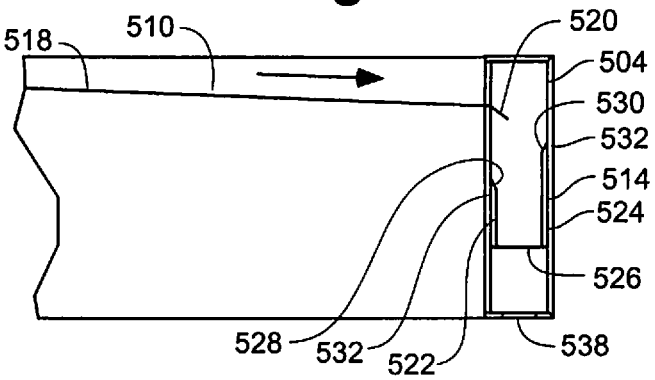
FIG. 37 is a detail cross sectional view depicting an internal drain and related structures.
Figure 38:
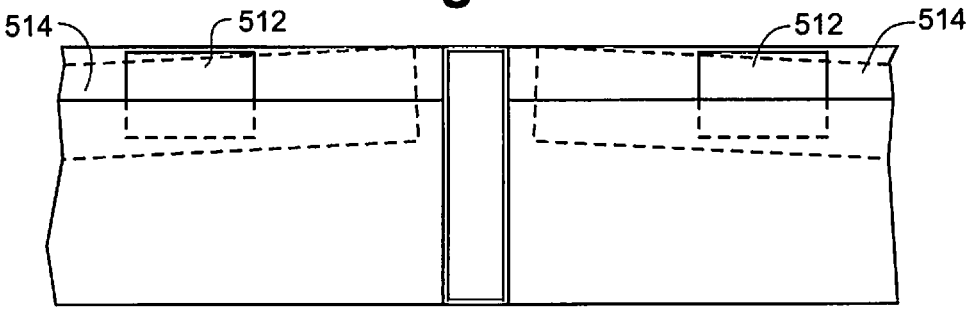
FIG. 38 is a detail elevational view with some structures depicted in phantom including the internal drain for precipitation.
Figure 39:
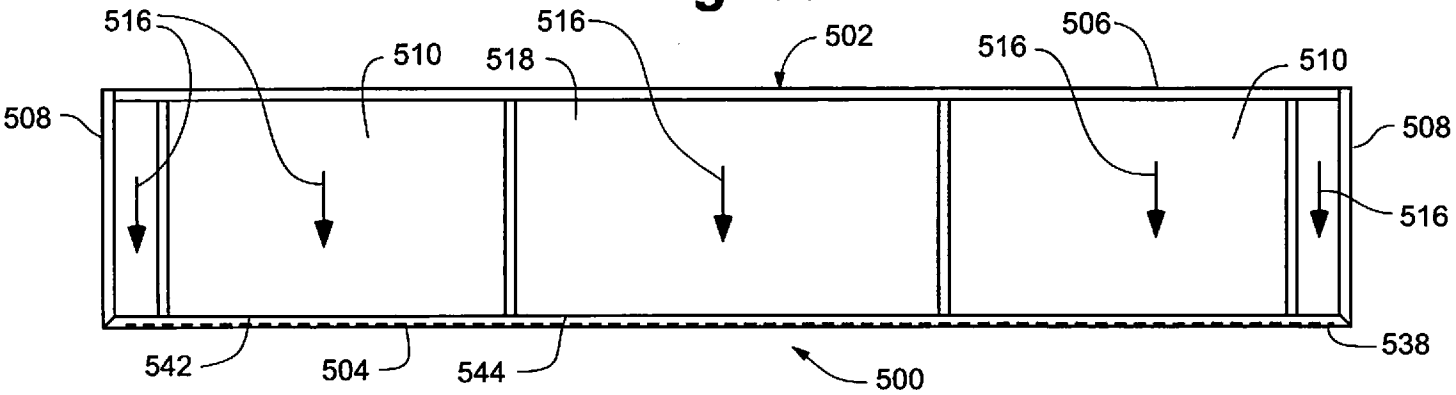
FIG. 39 is a plan view of a trellis with some structures depicted in phantom including an internal drain for precipitation and a continuous drain slot.
Figure 40:
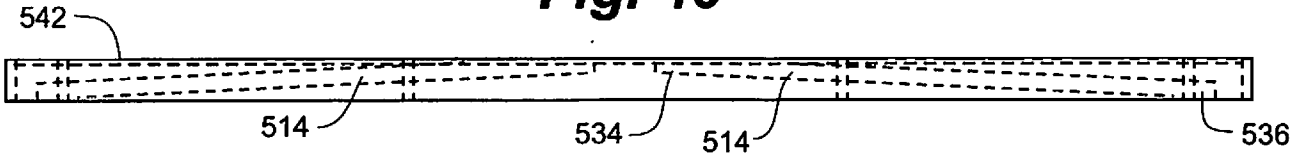
FIG. 40 is an elevational view of the trellis of FIG. 39 with some structures depicted in phantom including a continuous drain slot.

Referring now to FIGS. 35-41, embodiments of trellis 20 having an internal drain system 500 are depicted. According to an example embodiment depicted in FIGS. 35-38, internal drain trellis 502 generally includes front tube member 504, rear tube member 506, side tube members 508 and sloped in fill panels 510. In the depicted embodiment, internal drain trellis 502 includes drain slots 512 which may be interrupted as depicted in FIGS. 35-38 or a single continuous drain slot as depicted in FIGS. 39-40 and drain channel 514 located within front tube member 504. As discussed above, in this example embodiment, internal drain system 500 is located within front tube 504. However, this should not be considered limiting. Internal drain system 500 may be located in front tube member 504, rear tube member 506 or one or more of side tube members 508.

Referring further to FIGS. 35-38, in the depicted embodiment, front tube member 504 presents drain slots 512 passing through a wall thereof and drain channel 514 located therein. Sloped in fill panels 510 are sloped downward toward front tube member 504 as indicated by arrows 516 in FIG. 35. This should not be considered limiting as sloped in fill panels can slope toward any direction that internal drain system is located according to embodiments of the invention.

Referring particularly to FIG. 37, sloped in fill panels 510 generally include main portion 518 and drip edge 520. In the depicted embodiment, drip edge 520 extends through drain slots 512 into front tube member 504 and is, thus, located above drain channel 514.

Referring particularly to FIGS. 37 and 38, in the depicted embodiment, drain channel 514 generally includes short side wall 522, long side wall 524 and bottom wall 526. Generally, short side wall 522, long side wall 524 and bottom wall 526 will be integrally formed by a process such as extrusion. Drain channel 514 may also be formed by bending of flat materials. Drain channel 514 may be single piece, multiple pieces of formed metal or other materials of sufficient rigidity.

Referring particularly to FIG. 37, in the depicted embodiment, short side wall 522 presents short side wall flange 528 at a top edge thereof and long side wall 524 presents long side wall flange 530 at a top edge thereof. In an example embodiment, drain channel 514 may be secured to the interior of front tube member 504 by sealant 532 but can also be secured by other techniques known to those skilled in the art. It is notable that drain channel 514 is positioned such that short side wall 522 is located on the side of front tube member 504 including drain slots 512. Accordingly, short side wall 522 permits the drainage of water from drip edge 520 even at high end 534 of drain channel 514 because drip edge 520 is located above short side wall 522 even at high end 534. Gravity causes water to flow from high end 534 to low end 536 of drain channel 514.

Figure 36:
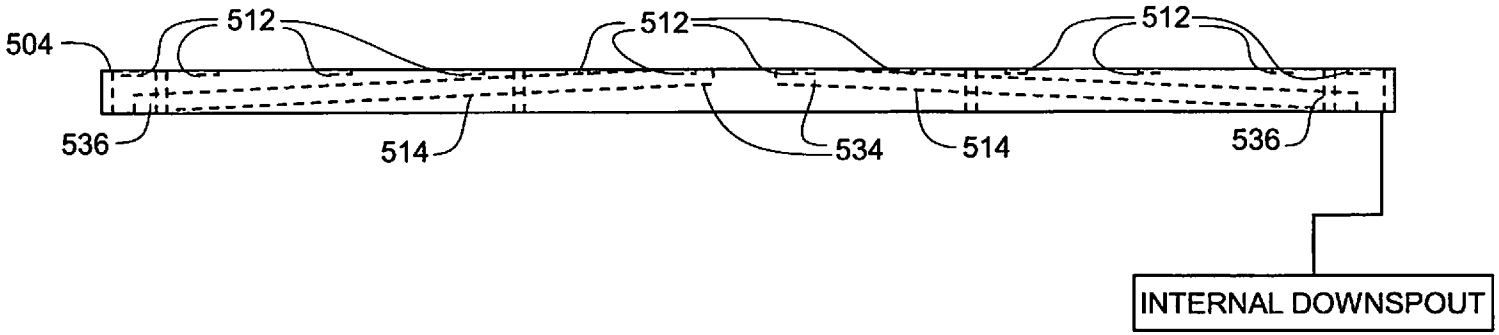
FIG. 36 is an elevational view of the trellis of FIG. 35 with some structures depicted in phantom including an internal drain for precipitation.

Referring particularly to FIG. 36, in the depicted embodiment, drain holes 538 are located at outer ends 540 of front tube member 504. Drain holes 538 may be located centrally or at outer ends 540, or at another desired location. Drain channel 514 may also have equal height side walls and be positioned so that the side walls are beneath drain slots 512.

According to one embodiment of the invention, drain holes 538 are located at outer ends 540 thus directing water away from building openings such as a door. According to another embodiment of the invention, when internal drain system 500 is located in rear tube member 506, drain holes 538 may be located centrally or at outer ends 540 and permit drainage into a building internal downspout system.

Referring now to FIGS. 39 and 40 another embodiment of internal drain trellis 502 is depicted. As depicted, internal drain trellis 502 is generally similar to internal drain trellis 502 of FIGS. 35 and 36 but includes continuous drain slot 542 in lieu of multiple drain slots 512. Similar structures are identified by similar reference numerals. Continuous drain slot 542 extends nearly the entire length of front tube member 504 but can be located in rear tube member 506 or one or both of side tube members 508 as well. Accordingly, continuous drip edge 544 may extend approximately the same length as continuous drain slot 542 or may be interrupted.

Figure 41:
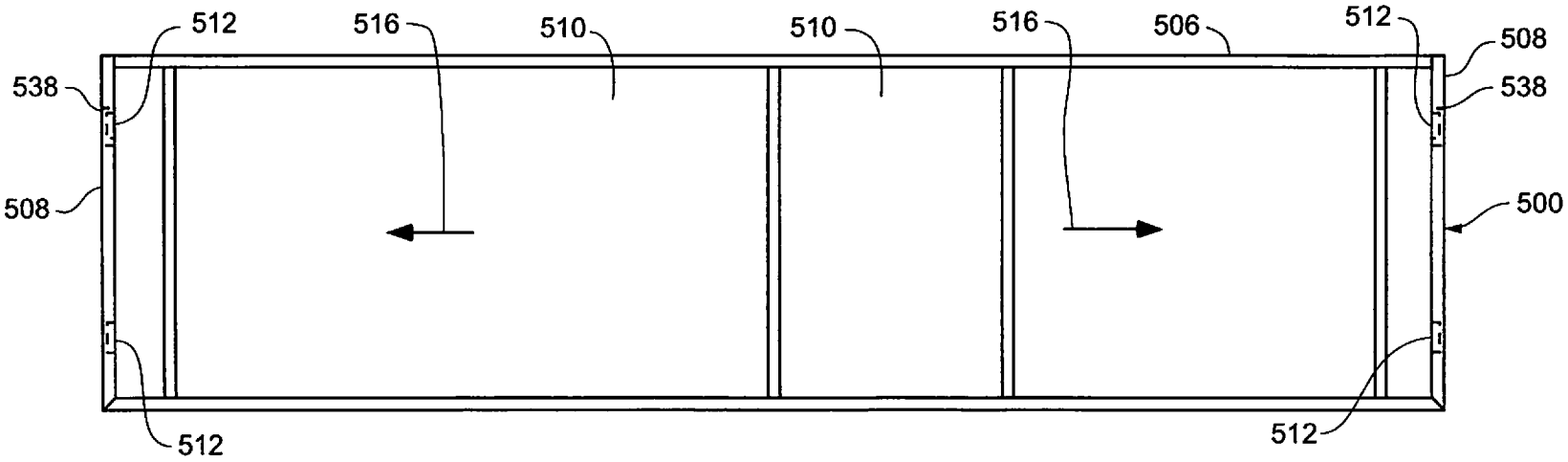
FIG. 41 is a plan view of a trellis with water flow directed toward end tubes and an internal drain located in the end tubes.

Referring to FIG. 41, an embodiment of internal drain trellis 502 is depicted in which sloped in fill panels 510 are sloped downwardly toward side tube members 508 and internal drain system 500 is housed in side tube members 508. Similar structures are labeled with similar reference numerals as in FIGS. 35-40 above.

Figure 42:
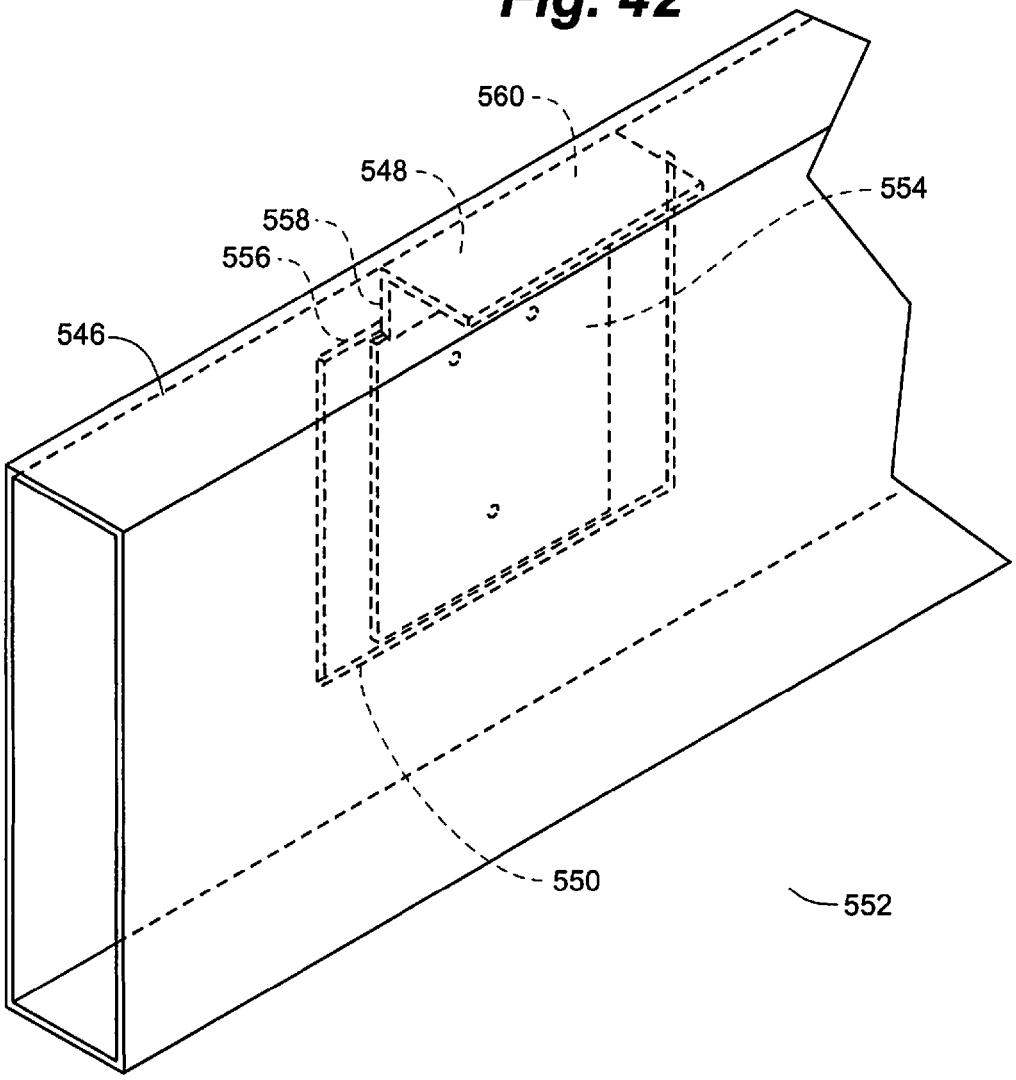
FIG. 42 is a perspective view of a rear tube member having an accent band clip according to an alternative example embodiment with some structures depicted in phantom.

Referring now to FIG. 42, accent band 546 supported by accent band clip 548 is depicted. In the depicted embodiment, accent band 543 is pierced by opening 550. Accent band clip is adapted to be secured to wall 552 for example by fasteners. Accent band clip 548 is a generally unitary structure and includes wall mount portion 554, offset portion 556, vertical support 558 and horizontal support 560. Offset portion 556, vertical support 558 and horizontal support 560 cooperate to support accent band 546 is close apposition to wall 552. Accent band 546 is hung on accent band clip 548 and held in place by gravity.

In operation, in one embodiment, to secure attachment assembly 408 and trellis 402, top anchoring clip 426 is secured to the building with fasteners 436 as ⅜" stainless steel lag bolts in combination with flat washers. Left-hand threaded stud 430 is operably coupled to top anchoring clip 426 to form one end of an anchor for tieback rod 424. Trellis 402 via back tube 40 is mounted to the building with fasteners 302 as ⅜" stainless steel lag bolts in combination with an SAE washer. Tieback rod 424 is then threaded into left-handed threaded stud 430 at first end 425 such that tieback rod 424 extends at an angle towards the distal end of cross member 50. Nut 434 is threaded onto right-handed threaded stud 432, and right-handed threaded stud 432 is threaded into tieback rod 424 at second end 427 such that nut 434 loosely abuts tieback rod 424. Right-handed threaded stud 432 is then operably coupled to bottom anchoring clip 428. Bottom anchoring clip is then operably coupled to cross member 50 at a position near the distal end of cross member 50. The trellis 402 is then leveled by turning tieback rod 424 and tightening nut 434 to lock tieback rod 424 securely in place. Finally, after the trellis 402 is cleaned with, for example, a xylene solvent, finish plugs are inserted at the trellis 402 anchoring.

In one embodiment, referring to FIG. 25, top anchoring clip 426 and fastener 302 for back tube 40 are secured through a relatively thin building wall material. In such an embodiment, fasteners 436 are, for example, ⅜"×6" stainless steel lag bolt and SAE washer. Likewise, fasteners 302 to secure cross member 50 back tube 40 are also ⅜"×6" stainless steel lag bolt and SAE washer. A double 2×10 wood blocking between studs can be utilized to support fasteners 436 as well as fasteners 302.

In another embodiment, referring to FIG. 26, top anchoring clip 426 and fastener 302 for back tube 40 are secured through a relatively thick building wall material. In such an embodiment, fasteners 436 are, for example, ⅜"×10" stainless steel lag bolt and SAE washer. Likewise, fasteners 302 to secure cross member 50 back tube 40 are also ⅜"×10" stainless steel lag bolt and SAE washer. A 2×10 wood blocking between studs can be utilized to support fasteners 436 as well as fasteners 302.

Figure 29:
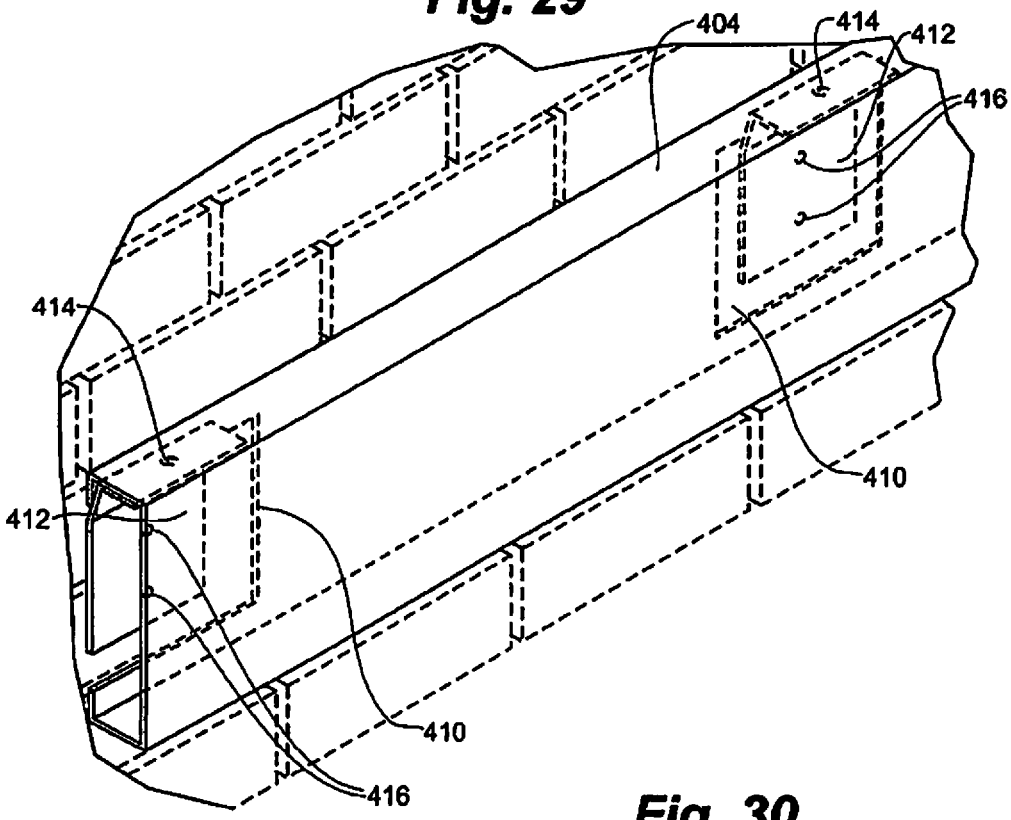
FIG. 29 shows a perspective view of a C-shaped accent band attached to a wall, according to an embodiment of the invention.
Figure 30:
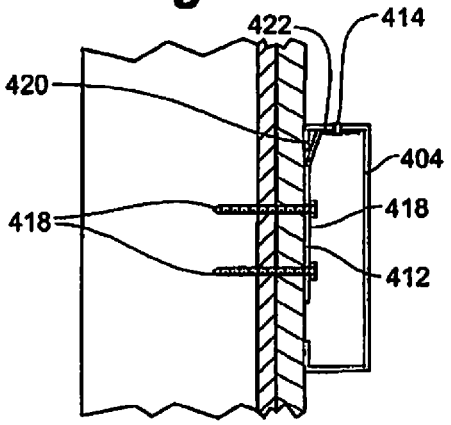
FIG. 30 shows a side perspective of an attachment of a C-shaped accent band to a wall, according to an embodiment of the invention.

Referring specifically to FIGS. 29 and 30, accent bands 404 comprise elongated tubes that can be affixed to the side of the building, as well as apertures 410 for receiving accent band clips 412. Accent bands 404, in one embodiment, harmoniously blend with the structure of the trellis. In another embodiment, the accent bands 404 can provide a counterpoint with the trellis, if that is the desired aesthetic appearance. Accent bands 404 are generally elongated tubes with a quadrilateral cross-section, and preferably a rectangular cross-section, as depicted in FIGS. 29 and 30.

Accent band clip 412 is substantially L-shaped, comprising a mounting portion 418 that is planar and designed to mount flush to the building wall surface, an angling portion 420 that provides a length such that accent band clip 412 angles from mounting portion 418, and a lip 422 that extends from angling portion 420. Lip 422 is substantially perpendicular to mounting portion 418, with angling portion 420 extended therebetween. Mounting portion 418 contains one or more apertures 416 for receiving fasteners 418 appropriate for mounting accent band 404 into the building wall surface. Aperture 416 can be a 3/16" hole, for example. Accent band clips 412 are secured to accent band 404 to provide support to accent band 404.

During installation of accent band 404, before mounting to the building wall surface, apertures 410 are created intermittently along the side of accent band 404 to be placed against the wall surface and positioned as required for respective accent band clips 412 to support accent band 404, whereby lip 422 is abuttingly engaged with the interior surface of the top of the respective accent band. Apertures 410 can be a 6"×6" square, for example. Fasteners 418, for example ¼" screws that meet building wall conditions, secure accent band clip 412 to the building wall surface through apertures 416. A secured accent band clip 412 is then received through aperture 410. Aperture 414 is created to define a void extending through the surface of accent band 404 that is orthogonally-facing to the building wall and abuttingly engaged with the lip 422 (for example, the top), and the surface of lip 422 of the respective accent band clip. Another fastener (a rivet, for example—not depicted) is placed through aperture 414 to secure accent band 404 to accent band clip 412.

Figure 28:
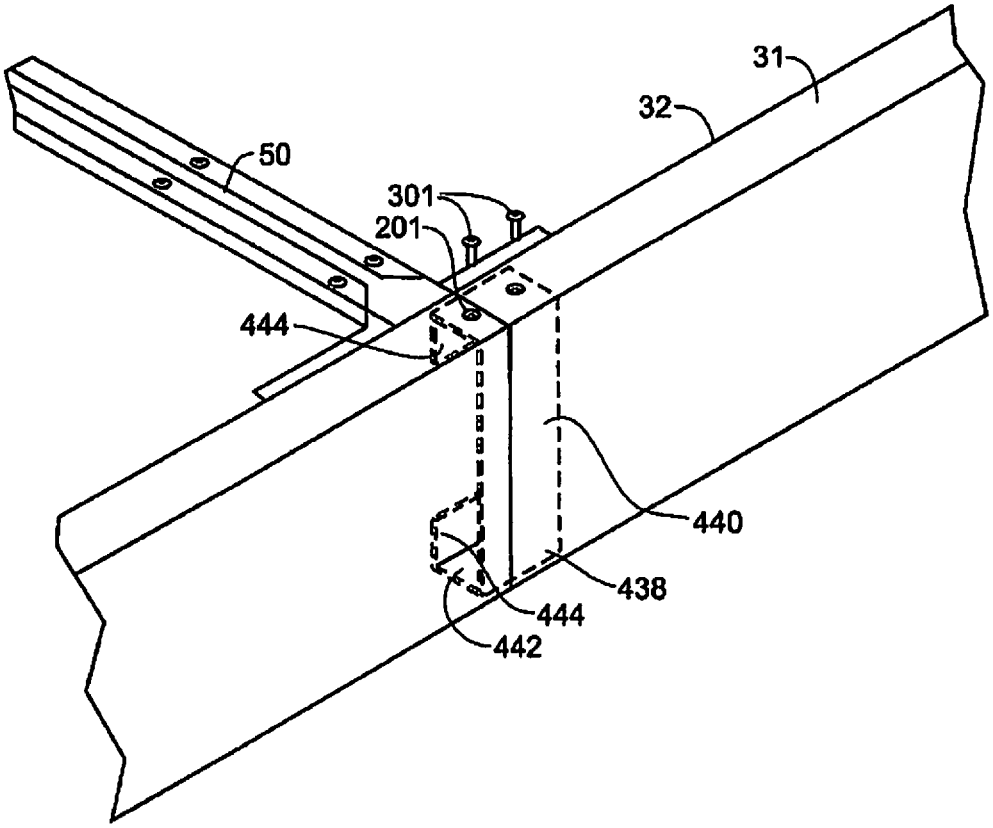
FIG. 28 shows a perspective view of a splice of two front tubes at a cross member, according to an embodiment of the invention.

Frame 30 can utilize a splice sleeve of shapes other than those that are U-shaped, according to an embodiment of the invention. Referring to FIG. 28, a splice sleeve 438 of a substantially C-shape is depicted. Splice sleeve 438 includes a planar segment 440 that forms the backbone of the C-shape. Legs 442 extend substantially perpendicularly from planar segment 440 at opposite ends of planar segment 440, but on the same side of planar segment 440, such that legs 442 are parallel to and apposition each other. Lips 444 extend substantially perpendicularly from each of legs 442 in a direction towards each other and therefore substantially parallel to planar segment 440. Splice sleeve 438 is configured to be abuttingly engageable with the interior surfaces of the end portions of a back tube 40, end tube 36 or front tube 32; the legs 442 of the splice sleeve 438 abuttingly engageable with a top 31, 41, 35, and a bottom surface 33, 43, 37, respectively, of a tube; the lips 444 of splice sleeve 438 abuttingly engageable with an opposing side from back tube 40, end tube 36 or front tube 32, respectively, from the portion of back tube 40, end tube 36 or front tube 32 abuttingly engaged with planar segment 440. The surface of at least one of the legs 442 of the splice sleeve 438 defines at least two apertures 201, each adapted to receive a fastener 301.

Figure 31:
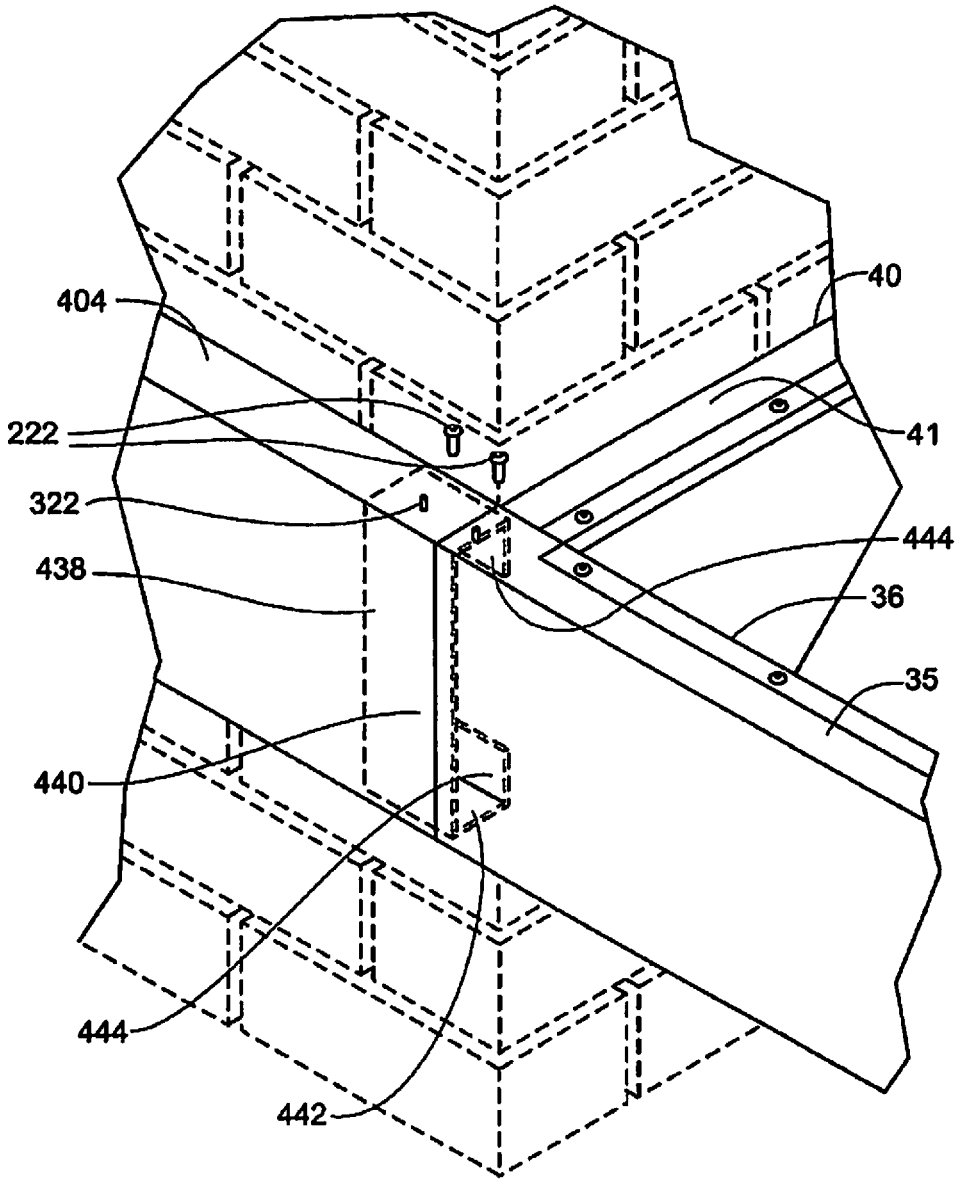
FIG. 31 shows a perspective view of a joining of an accent band, back tube, and end tube, at a building corner, according to an embodiment of the invention.

Referring to FIG. 31, a C-shaped splice sleeve 438 can be utilized to join accent band 404 with the assembled trellis 402. After the trellis 402 is installed, the accent band 404 is slid into the back of the trellis such that a hairline joint is created with the end tube 36. The splice sleeve 438 is positioned such that a portion of each of the legs 442 overlaps the interior surface of the accent band 404 and a portion of each of the legs 442 overlaps the interior surface of end tube 36. Planar segment 440 and lips 444 abuttingly engage opposite sides of the interior surfaces of both accent band 404 and end tube 36 to provide additional support. Apertures 222 are created once the splice sleeve 438 is positioned so that one aperture 222 is placed through accent band 404 and one aperture 222 is placed through end tube top 35. In one embodiment, apertures 222 are 3/16" holes. Fastener 322 is positioned at the top of the accent band 404 and end tube top 35 surfaces and subsequently passes through aperture 222, and is used to fasten the accent band 404 and the end tube 36 to the splice sleeve 438. In one embodiment, fasteners 322 are 3/16" rivets.

Figure 34:
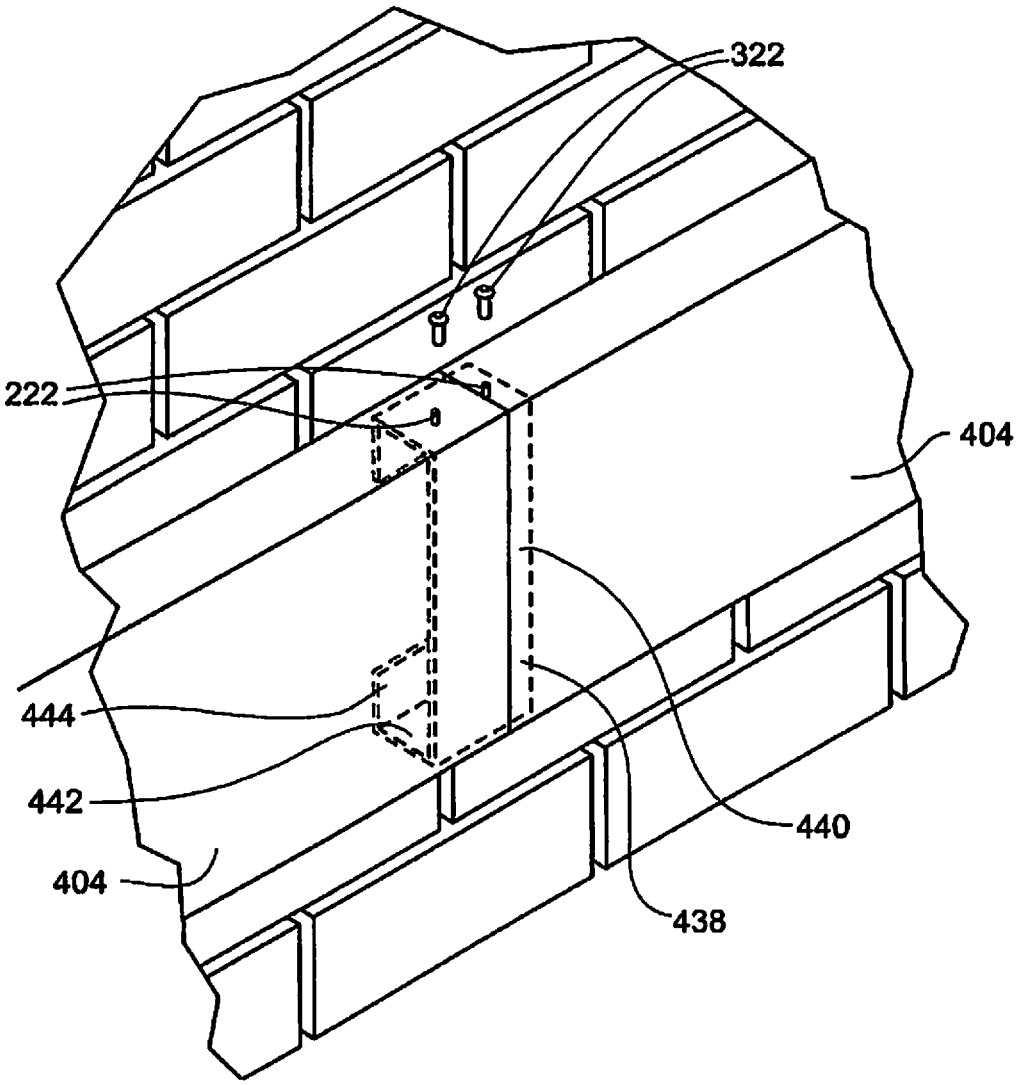
FIG. 34 shows a perspective view of two accent bands joined along a building wall.
Figure 35:
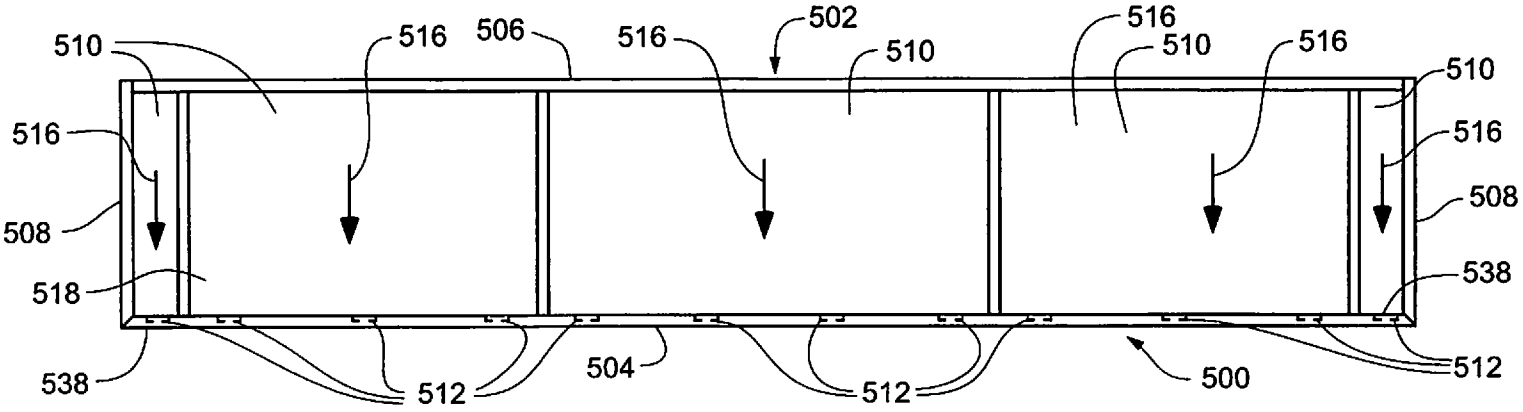
FIG. 35 is a plan view of a trellis with some structures depicted in phantom including an internal drain for precipitation and a plurality of drain slots.

Using splice sleeve 438, as described above, the accent bands 404 can be spliced to one another, to the back tube 40 and/or the end tubes 36, resulting in a hairline joint. An example of a splice of two accent bands 404 is shown in FIG. 34. The adjacent accent bands 404 or tubes that create the aforementioned hairline joints can be operably coupled using the aperture and fastener placement described above.

Figure 32:
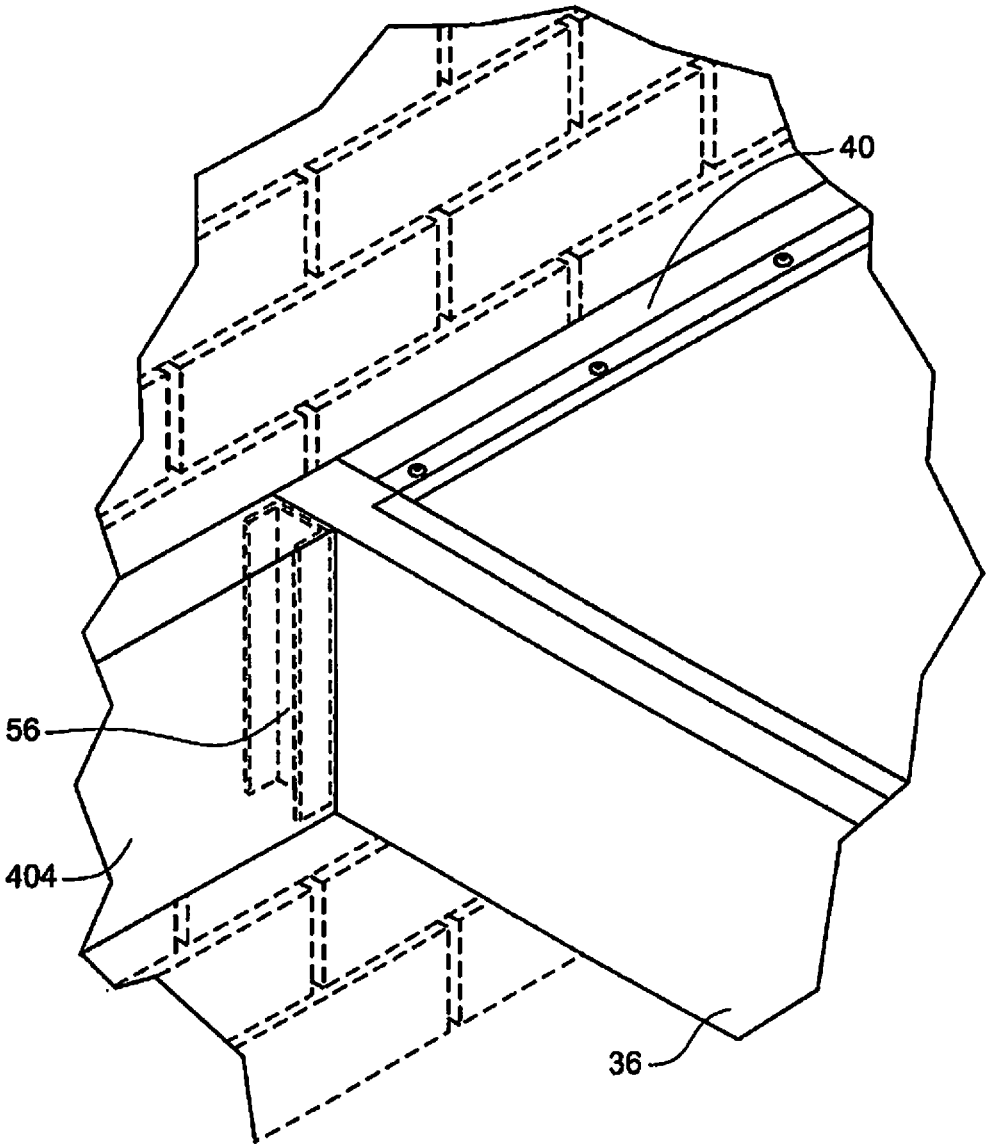
FIG. 32 shows a perspective view of a joining of an accent band and end tube, according to an embodiment of the invention.
Figure 33:
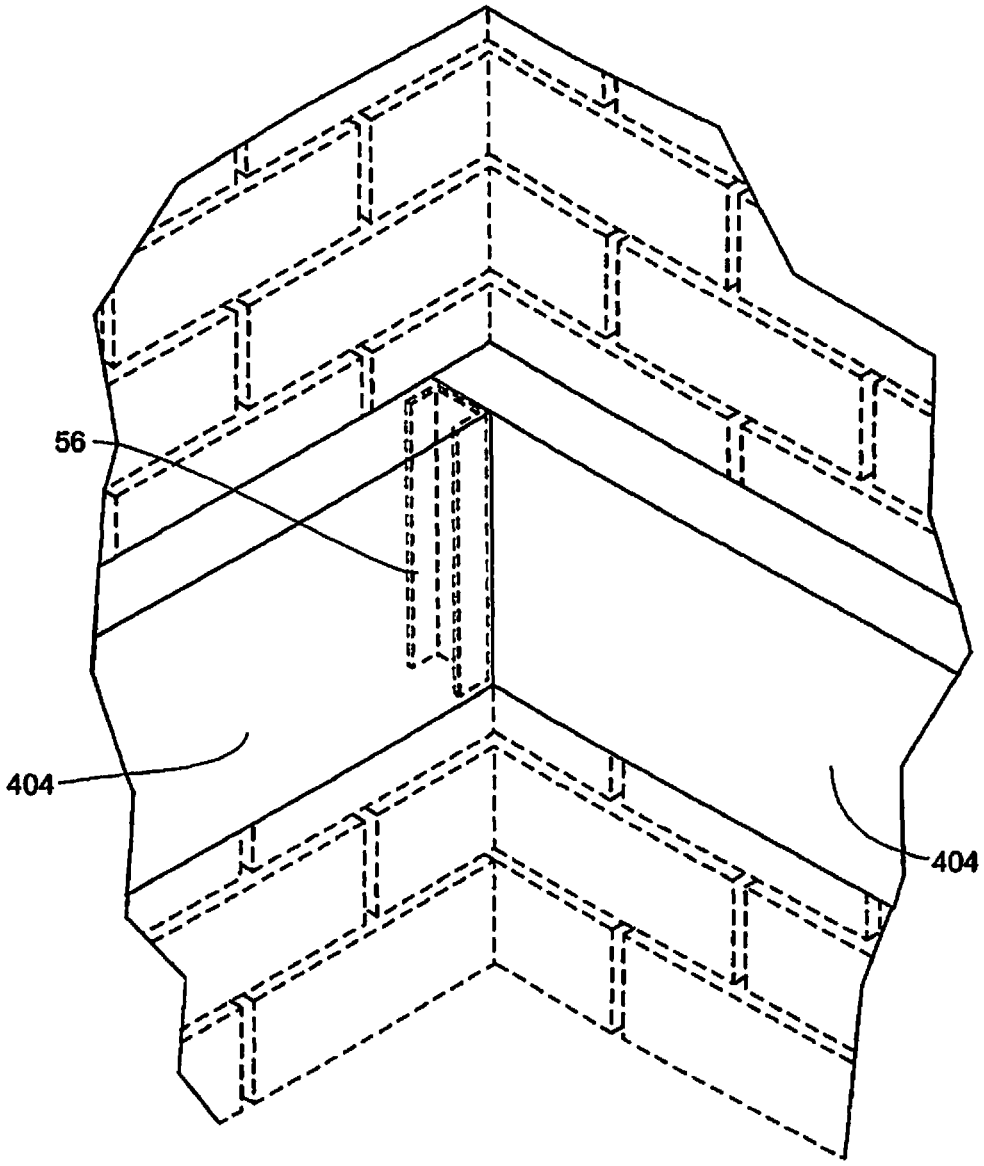
FIG. 33 shows a perspective view of two accent bands joined at a building exterior corner, according to an embodiment of the invention.

To turn corners with accent band 404, a shear block 56 can be utilized. Referring to FIG. 32, a corner turn between an end tube 36 and an accent band 404 is depicted, wherein a shear block 56 is affixed to the end tube 36. Accent band 404 is then slid over shear block 56 to create a hairline joint, with accent band 404 positioned orthogonally to end tube 36. Referring to FIG. 33, a corner turn between two accent bands 404 is depicted, wherein a shear block 56 is affixed to a first accent band 404. A second accent band 404 fits over the shear block 56, with second accent band 404 positioned orthogonally to first accent band 404. A hairline joint is thus created between first accent band 404 and second accent band 404.

Internal drain trellis 502 including internal drain system 500 is assembled by placing front tube member 504 an appropriate distance from rear tube member 506 and coupling them together with side tube members 508. Sloped in fill panels 510 are placed in their appropriate locations with drip edge 520 engaged with drain slots 512. The assembled internal drain trellis 502 is then secured to the side of a building as explained elsewhere herein.

Precipitation that is received on top of slope in fill channels 510 drains to drain slots 512 via drip edge 520. Water leaving drip edge 520 falls into drain channel 514 via drain slots 512. Water is then directed down drain channel 514 from high end 534 to low end 536. Water exits drain channel 514 and exits internal drain system 500 at drain holes 538. As discussed above, drain holes 538 may be positioned at a number of locations on internal drain trellis 502. Further, drain holes 538 may be lead to an internal downspout to a building to join other drainage water from a flat roof in departing the structure.

Those skilled in the art will recognize that the present invention may be manifested in a variety of forms other than the specific embodiments described and contemplated herein. Accordingly, departures in form and detail may be made without departing from the scope and spirit of the present invention as described in the appended claims.

For purposes of interpreting the claims for the present invention, it is expressly intended that the provisions of Section 112, sixth paragraph of 35 U.S.C. are not to be invoked unless the specific terms "means for" or "step for" are recited in a claim.

The invention claimed is:

1. A trellis system, comprising:

a plurality of tube members including a front tube, a back tube and two end tubes;

wherein the two end tubes comprise a first end tube and a second end tube and each of the first end tube and the second end tube comprise a first end portion and a second end portion and a first end portion of the front tube is coupled to the first end portion of the first end tube and the second end portion of the front tube is coupled to the first end portion of the second end tube, and the first end portion of the back tube is coupled to the second end portion of a first end tube and the second end portion of the back tube is coupled to the second end portion of the second end tube;

a plurality of roof panels, each panel having a perimeter, wherein a portion of the perimeter of one of the plurality of roof panels is coupled to at least two of the front tube, the back tube and the two end tubes;

at least one of the plurality of roof panels being sloped downwardly toward a downward end at one of the front tube, the back tube and the two end tubes; and an internal drainage system located within at least one of the front tube, the back tube and the two end tubes located at the downward end;

wherein the one of the tube members containing the internal drainage system further defines at least one drainage opening passing through a wall of the tube member, each of the at least one drainage openings being engaged to a drip edge at the downward end of the roof panels.

2. The trellis as claimed in claim 1, wherein the internal drainage system further comprises an internal channel located within the at least one tube member located at the downward end.

3. The trellis as claimed in claim 2, wherein the internal channel, when viewed in cross section, comprises a short side wall, a long side wall and a bottom wall.

4. The trellis as claimed in claim 3, wherein the short side wall is engaged to a wall of the tube member that comprises drainage slots and is adjacent the downward end of at least one of the roof panels.

5. The trellis as claimed in claim 2, wherein the internal channel is sloped downwardly toward an outside corner of the trellis.

6. The trellis as claimed in claim 2, wherein the internal channel is sloped downwardly toward an inside corner of the trellis.

7. The trellis as claimed in claim 6, further comprising an internal downspout and wherein the channel is in fluid communication with the internal downspout and the internal downspout is located interior to a building to which the trellis is secured and through which precipitation water drains from the channel.

8. The trellis system of claim 1, wherein the trellis system is made of metal selected from a group consisting of aluminum and ferrous alloys.

9. The trellis system of claim 1, wherein the at least one drainage opening comprises a single continuous opening.

10. The trellis system of claim 1, wherein the at least one drainage opening comprises multiple drainage openings.

11. The trellis system of claim 1, wherein at least one of the roof panels further comprises a drip edge at the downward end thereof.

12. The trellis system of claim 3, wherein the internal channel further comprises a short side wall flange at a top edge of the short side wall and wherein the short side wall flange is engaged against an interior of the at least one tube member located at the downward end.

13. A method of draining precipitation from a trellis system, comprising:

securing at least one roof panel within a perimeter formed by a plurality of tube members including a front tube, a back tube and two end tubes;

perforating at least one of the plurality of tube members to create at least one drain opening into the at least one tube member to receive a downward edge of the at least one roof panel;

inserting at least a portion of the downward edge of the at least one roof panel at least partially into the at least one drain opening; and locating an internal drainage system within the at least one tube member.

14. The method as claimed in claim 13, further comprising placing an internal channel within the at least one tube member.

15. The method as claimed in claim 13, further comprising engaging a drip edge of the at least one roof panel at least partially into the at least one drain opening.

16. The method as claimed in claim 14, further comprising forming or selecting the internal channel such that, when viewed in cross section, the internal channel comprises a short side wall, a long side wall and a bottom wall.

17. The method as claimed in claim 16, further comprising engaging the short side wall to a wall of the tube member that presents the at least one drain opening and is adjacent the downward end of the at least one roof panel.

18. The method as claimed in claim 14, further comprising sloping the internal channel downwardly toward an outside corner of the trellis.

19. The method as claimed in claim 14, further comprising sloping the internal channel downwardly toward an inside corner of the trellis.

20. The method as claimed in claim 14, further comprising coupling the internal channel in fluid communication with an internal downspout located interior to a building to which the trellis is secured and through which precipitation water drains from the channel.

21. The method as claimed in claim 14, further comprising making the trellis of metal selected from group consisting of aluminum and ferrous alloys.

22. The method as claimed in claim 14, further comprising making the at least one drain opening a single continuous opening.

23. The method as claimed in claim 14, further comprising making the at least one drain opening as multiple drainage openings.

24. The method as claimed in claim 14, further comprising forming or selecting the internal channel such that, when viewed in cross section, the internal channel comprises a short side wall flange at a top edge of the short side wall and engaging the short side wall flange against an interior of the at least one tube member located at the downward end.

* * * * *